US007011226B2

(12) United States Patent
Uchiyama

(10) Patent No.: US 7,011,226 B2
(45) Date of Patent: Mar. 14, 2006

(54) PLUGGING MEMBER FOR A DRAIN PORT HAVING A PORTION WITH DECREASED THICKNESS AND CONTAINER USING THE SAME

(75) Inventor: Kimiyoshi Uchiyama, Kanagawa (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 33 days.

(21) Appl. No.: 10/443,769

(22) Filed: May 23, 2003

(65) Prior Publication Data

US 2003/0196984 A1 Oct. 23, 2003

Related U.S. Application Data

(63) Continuation of application No. 09/274,319, filed on Mar. 23, 1999, now abandoned.

(30) Foreign Application Priority Data

Mar. 31, 1998 (JP) ..... 10-105787
Mar. 31, 1998 (JP) ..... 10-105788

(51) Int. Cl.
*B65D 51/00* (2006.01)

(52) U.S. Cl. ..... 220/229; 220/DIG. 19; 220/255.1; 220/254.1; 215/253

(58) Field of Classification Search ..... 220/229, 220/256, 254, 240, DIG. 19, 89.2, 255.1, 220/254.1; 215/363, 356, 270, 271, 250, 215/253, 303; 222/541.2, 541.6, 541.4; 141/239, 141/351, 364; 137/68.19, 68.27, 68.29, 68.23; 138/89, 90; 396/626
See application file for complete search history.

(56) References Cited

U.S. PATENT DOCUMENTS

| | | | |
|---|---|---|---|
| 571,708 | A | 11/1896 | Thompson |
| 1,989,145 | A | 1/1935 | Newby |
| 3,380,610 | A | 4/1968 | Krieps |
| 3,379,936 | A | 6/1973 | Jones, Jr. |
| 3,845,879 | A | 11/1974 | Dembach et al. |
| 3,921,556 | A | 11/1975 | Wood et al. |
| 4,053,084 | A | 10/1977 | Anderson |
| 4,105,133 | A | 8/1978 | La Barge et al. |
| 4,308,885 | A | 1/1982 | Geisseler |
| 4,416,388 | A | 11/1983 | Mulawski |
| 4,463,865 | A | 8/1984 | Mundt et al. |
| 4,655,070 | A | 4/1987 | Clift |
| 4,874,102 | A | 10/1989 | Jessop et al. |
| 4,884,717 | A | 12/1989 | Bussard et al. |
| 4,902,043 | A | 2/1990 | Zillig et al. |

(Continued)

FOREIGN PATENT DOCUMENTS

DE 2820566 11/1979

(Continued)

*Primary Examiner*—Robin A. Hylton
(74) *Attorney, Agent, or Firm*—Buchanan Ingersoll PC

(57) ABSTRACT

In each of radial grooves 52 which are formed on a sealing disc portion 34 of a packing 10, low strength portions 64 are formed within a predetermined range from the center of the sealing disc portion 34 by decreasing the thickness of each of thin portions 62 by deeply cutting each of the radial grooves 52. When the center of the sealing disc portion 34 is pressed by the pressing means, splits are formed at the low strength portions 64, and extend to curved grooves 54 and circumferential grooves 56. As a result, it is possible to obtain a plugging member in which a draining port can be opened wide with a small amount of pressing force.

53 Claims, 17 Drawing Sheets

U.S. PATENT DOCUMENTS

| | | | | |
|---|---|---|---|---|
| 5,060,971 | A | | 10/1991 | Nanbu et al. |
| 5,080,124 | A | | 1/1992 | McGregor et al. |
| 5,111,946 | A | | 5/1992 | Glanz |
| 5,397,023 | A | | 3/1995 | Toczek et al. |
| 3,257,026 | A | | 6/1996 | Taylor |
| 5,543,884 | A | * | 8/1996 | Earle et al. ..... 396/626 |
| 5,544,779 | A | | 8/1996 | Yamamoto et al. |
| 5,675,792 | A | | 10/1997 | Earle et al. |
| 5,956,539 | A | | 9/1999 | Fitterman et al. |
| 5,961,011 | A | | 10/1999 | Thomas et al. |
| 5,984,538 | A | | 11/1999 | Sherburne et al. |
| 6,000,578 | A | | 12/1999 | Boissay |
| 6,035,896 | A | | 3/2000 | Liardet |
| 6,075,963 | A | | 6/2000 | Ichikawa et al. |

FOREIGN PATENT DOCUMENTS

| | | |
|---|---|---|
| EP | 339729 | 11/1989 |
| FR | 1049694 | 12/1953 |
| FR | 2 716 669 | 9/1995 |
| GB | 1441819 | 7/1976 |
| GB | 2254836 | 10/1992 |
| JP | 8-53147 | 2/1996 |

* cited by examiner

PLUGGING MEMBER FOR A DRAIN PORT HAVING A PORTION WITH DECREASED THICKNESS AND CONTAINER USING THE SAME

This application is a continuation application of application Ser. No. 09/274,319, filed on Mar. 23, 1999 now abandoned.

BACKGROUND OF THE INVENTION

1. Field of the Invention

The present invention relates to a plugging member and a container, and more particularly to a plugging member which plugs a draining port for draining a material which is contained in a container, and the container. For example, the plugging member is used to plug a draining port of a photographic processing chemicals container which contains therein photographic processing chemicals.

2. Description of the Related Art

As an example of a conventional plugging member, a plugging sheet 300 as a plugging element which plugs a bottle is shown in FIG. 19 (see Japanese Patent Application Laid-Open (JP-A) No. 8-53147).

In this plugging sheet 300, three fan portions 306 are formed from three radial portions 302 which comprise thin portions and three circumferential portions 304 which comprise thin portions. Each of the fan portions 306 is attached to a plugging element 310 by attaching portions 308.

When this plugging sheet 300 is pressed and perforated by a protruding portion of a perforating means which is not shown, since splits are formed from the center of the plugging sheet 300 along the radial portions 302 and then, the splits extend along the circumferential portions 304, respectively, the plugging sheet 300 is opened over the entire cross section of the opening of the bottle.

However, in this plugging sheet 300, since the thin portions are curved at a small radius of curvature from the radial portions 302 to the circumferential portions 304, there may be cases in which the force which has acted upon the radial portions 302 does not extend to the circumferential portions 304. For this reason, when the amount of pressing force excited by the perforating means is small, the splits do not extend from the tip ends of the radial portions 302 to the circumferential portions 304, and the fan portions 306 are bent at positions indicated by a dashed line C6 in FIG. 19. Accordingly, it is impossible to open the plugging sheet 300 over the entire cross section of the opening of the bottle. As a result, the surface area of the opening is made narrower.

This plugging sheet 300 is formed from a high polymer material or a mixture of high polymer materials. Three fan portions 306 are formed by three radial portions 302 which have a thickness of between 0.1 and 0.3 mm and by three circumferential portions 304 which have a thickness of between 0.1 and 0.3 mm, similarly to the thickness of the three radial portions 302. The fan portions 306 are each attached to a plugging element 310 by the attaching portions 308.

When this plugging sheet 300 is pressed and perforated by the protruding portion of a perforating means which is not shown, since splits extend from the center of the plugging sheet 300 along the radial portions 302, and then extend along the circumferential portions 304, the plugging sheet 300 is opened over the entire cross section of the opening of the bottle.

However, in this plugging sheet 300, if the thicknesses of the plugging sheet 300 in the areas adjacent to the radial portions 302 and the circumferential portions 304, each of which has a thickness of between 0.1 mm and 0.3 mm, is close to the thicknesses of the radial portions 302 and the circumferential portions 304 (if, for example, the thickness of the radial portions 302 and the circumferential portions 304 of 0.3 mm and the thickness of the fan portions 306 is 0.4 mm), a portion of the tensional force which is supposed to act upon the radial portion 302 or the circumferential portions 304 due to the pressing force from the perforating means is dispersed and acts upon the fan portions 306. Accordingly, the fan portions 306 are thereby stretched out together with the radial portions 302 or the circumferential portions 304. As a result, in order to perforate the plugging sheet 300, a large amount of pressing force is needed.

SUMMARY OF THE INVENTION

In view of the aforementioned facts, it is an object of the present invention to obtain a plugging member which can open a draining port wide with a low pressing force, and a container whose draining port is plugged by this plugging member.

The first aspect of the present invention is a plugging member which plugs a draining port for draining a material which is contained in a container, comprising: a plugging plate body which is mounted in the draining port and is able to plug the draining port; and a thin portion which is formed by decreasing the thickness of the plugging plate body in portions in the thickness direction thereof, using a concave portion which is formed linearly on one end surface of the plugging plate body in the thickness direction thereof and which is formed with a predetermined width or with a width which decreases from the one end surface to the other end surface of the plugging plate body in the thickness direction thereof, wherein the thinnest portion of the thin portion has the thickness T2 which ranges from not less than 0.05 mm to not more than 0.7 mm, the surfaces which face each other and form the concave portion are in parallel with each other, or the angle θ which is formed by the facing surfaces is more than 0° and equal to or less than 120°, and the ratio (L/T2) of the thickness L of the plugging plate body to the thickness T2 is equal to or more than 2.

In the state in which the plugging member is attached to the draining port, the draining port is plugged by the plugging plate body. In this state, when the substantially central portion of the plugging plate body is pressed by the pressing means such as a bar or the like, the tensional force acts upon portions of the plugging plate body at both sides of each of the thin portions in the direction in which the portions of the plugging plate body are made to separate from each other.

The ratio (L/T2) of the thickness L of the plugging plate body to the thickness T2 which is the thinnest portion of the thin portion is equal to or more than 2. As compared to the thin portion, the portion of the plugging plate body on which a concave portion is not formed has a thickness which is equal to or more than a predetermined value. The opposite surfaces forming a concave portion are made to be in parallel with each other, or approach to each other so that the angle θ which is formed by the opposite surfaces is more than 0° and is equal to or less than 120°. The plugging plate body has a predetermined thickness at both side portions of the thin portion (on which the sloping surfaces are formed). For this reason, the tensional force generated from both side portions of the thin portion is concentrated at the thin portion. Since the thickness T2 of the thinnest portion of the thin portion is equal to or less than 0.7 mm, the plugging plate body is broken along the thin portion by the tensional force which has concentrated at the thin portion.

The thickness T2 of the thinnest portion of the thin portion is equal to or more than 0.05 mm, and a predetermined strength is secured. Therefore, in the state in which the draining port is plugged by the plugging member, when the pressing force acts upon the plugging member due to an increase in the internal pressure of the container, the plugging plate body does not unexpectedly break.

Examples of the cross sectional configuration of the concave portion which is formed by decreasing the thickness of the plugging plate body in portions may include: a rectangular shape in which the surfaces facing each other and forming the concave portion are in parallel with each other; a substantially trapezoidal shape in which the opposite surfaces gradually approach to each other toward the other end surface of the plugging plate body; and a substantially V-shape in which the end portions of the opposite surfaces contact with each other.

The second aspect of the present invention is a plugging member according to the first aspect of the present invention, wherein a low strength portion is formed at the thin portion by decreasing the strength of the thin portion within a predetermined range from the center of the plugging plate body.

When the plugging plate body is pressed by the pressing means, firstly, the low strength portion is broken, and then, the broken portion extends to the portion of the plugging plate body other than the low strength portion (outside the predetermined range from the center of the plugging plate body). For this reason, over the entire body of the plugging plate body, the plugging plate body can be broken with an even smaller amount of pressing force as compared to the plugging plate body on which the low strength portion is not formed.

In the thin portion other than the low strength portion, since the thin portion has a strength which is higher than the low strength portion, for example, the plugging plate body is not broken unexpectedly due to the increase of the internal pressure of the container.

The third aspect of the present invention is a plugging member according to the first aspect of the present invention, wherein three or more of the thin portions are formed, and portions of these thin portions are low strength portions whose strength is made lower than the other thin portions.

When the plugging plate body is pressed by the pressing means, the low strength portions are broken, and then, the broken portion extends to the portions of the plugging plate body other than the low strength portions. For this reason, over the entire body of the plugging plate body, the plugging plate body can be broken with a much more smaller amount of pressing force as compared to the plugging plate body on which the low strength portions are not formed.

Since the thin portions other than the low strength portions have a strength which is higher than the low strength portions, for example, the plugging plate body is not broken unexpectedly due to an increase of the internal pressure of the container or the like.

One low strength portion or a plurality of low strength portions can be provided. Further, low strength portions may be formed by applying different strengths to three or more of thin portions.

The fourth aspect of the present invention is a plugging member according to the third aspect of the present invention, wherein a high strength portion is formed on the thin portions by increasing the strength of the thin portions outside a predetermined range from the center of the plugging plate body.

Firstly, the low strength thin portions are broken by the pressing force of the pressing means. However, the breaking is obstructed by the high strength portions which are formed in the low strength thin portions. The tensional force acting upon the thin portions by the pressing force of the pressing means extends to the thin portions other than the aforementioned portions (the portions other than the low strength thin portions). Namely, the tensional force due to the pressing force of the pressing means is dispersed to and acts upon a plurality of thin portions (including the low strength thin portion) at different times so that all of the thin portions can be broken.

The fifth aspect of the present invention is a plugging member according to the first to fourth aspects of the present invention, wherein the plugging plate body is formed in a disc plate shape whose outer diameter R is not less than 0.5 cm and not more than 5 cm.

Accordingly, the plugging plate body has a predetermined strength, and the thin portion can be broken with a small amount of the pressing force.

The sixth aspect of the present invention is a plugging member which plugs a draining port for draining a material which is contained in a container, comprising: a plugging plate body which is mounted in the draining port and is able to plug the draining port; and a low strength portion which is formed on the plugging plate body where the strength of the plugging plate body is decreased by a plurality of radial portions which are formed radiating out from substantially the central portion of the plugging plate body toward the external edge thereof, a plurality of curved portions which are formed so as to be curved in an arcuate shape and continue from the tip end of each of the radial portions, and a plurality of circumferential portions which are formed so as to extend from the tip end of each of the curved portions in the direction along the edge of the opening of the draining port.

In the state in which the plugging member is mounted in the draining port, the plugging plate body plugs the draining port. In this state, when substantially the central portion of the plugging plate body is pressed by the pressing means such as a bar or the like, then at substantially the central portion of the plugging plate body, tensional force acts upon portions of the plugging plate body on both sides of each of the radial portions in the longitudinal direction thereof in the direction in which the portions of the plugging plate body are made to separate from each other, and substantially the central portion of the plugging plate body splits along the radial portions. This split extends to the outer edge of the plugging plate body along the radial portions, and further extends to the circumferential portions by way of the curved portions.

Since the circumferential portions are formed in the same direction as the edge of the opening of the draining port, the plugging plate body is broken along the edge of the opening of the draining port at portions where these circumferential portions are formed. For this reason, the plugging plate body is opened wide along the edge of the opening of the draining port.

Further, the radial portions and the circumferential portions are connected to each other, through the curved portions each of which is curved in an arcuate shape. Accordingly, the radial portions and the circumferential portions are not structured such that they deviate so as to connect to each other. For this reason, even if the pressing force by the pressing means is low, the tensional force, which has acted upon the respective radial portions, also acts upon the respective circumferential portions and the plugging plate body can thereby be broken along the circumferential portions.

The radial portions are not necessarily formed radiating from the center of the plugging plate body, and instead may be formed radiating from the substantially central portion (at a position slightly displaced from the center) of the plugging plate body provided that the plugging plate body is split along the radial portions by the pressing force from the pressing means.

The seventh aspect of the present invention is a plugging member according to the sixth aspect of the present invention, wherein the low strength portion is a groove which is formed by decreasing the thickness of the plugging plate body in portions.

By forming a groove on the plugging plate body, the cross sectional area of the plugging plate body in the groove portion decreases. Accordingly, the tensional force is concentrated in the groove portion, and the plugging plate body is broken along the groove. In this way, the low strength portion can be formed by a simple structure in which the groove is formed by decreasing the thickness of the plugging plate body in portions.

Other than the structure in which the thin portion is formed so as to be in continuous, the groove of the present invention may be formed by a structure in which the thin portion is formed intermittently at a predetermined distance so as to form as a whole a series of perforation.

The eighth aspect of the present invention is a container in which a draining port for draining a material contained therein is formed, and the draining port is plugged by the plugging member according to the first to seventh aspects of the present invention.

Because the draining port of the container is plugged by the plugging member, the material contained in the container does not leak from the container. Since air or the like does not flow into the container, changes in the characteristics or properties of the material contained therein can be prevented.

In the state in which the plugging member is attached to the draining port, namely, without detaching the plugging member from the draining port, the substantially central portion of the plugging plate body is pressed by the pressing means such as a bar or the like. The plugging plate body is opened wide along the edge of the opening of the draining port, and the material contained in the container can be emptied out.

The ninth aspect of the present invention is a container according to the eighth aspect of the present invention, wherein the container is used for the purpose of containing therein photographic processing chemicals.

The photographic processing chemicals do not leak from the container, and change in the characteristics or properties of the material contained in the container can be prevented.

In the state in which the plugging member is attached to the draining port, the substantially central portion of the plugging plate body is pressed by a pressing means such as a bar or the like. The plugging plate body is opened wide along the edge of the opening of the draining port, and the photographic processing chemicals can be emptied out.

DESCRIPTION OF THE PREFERRED EMBODIMENTS

Figure 1:
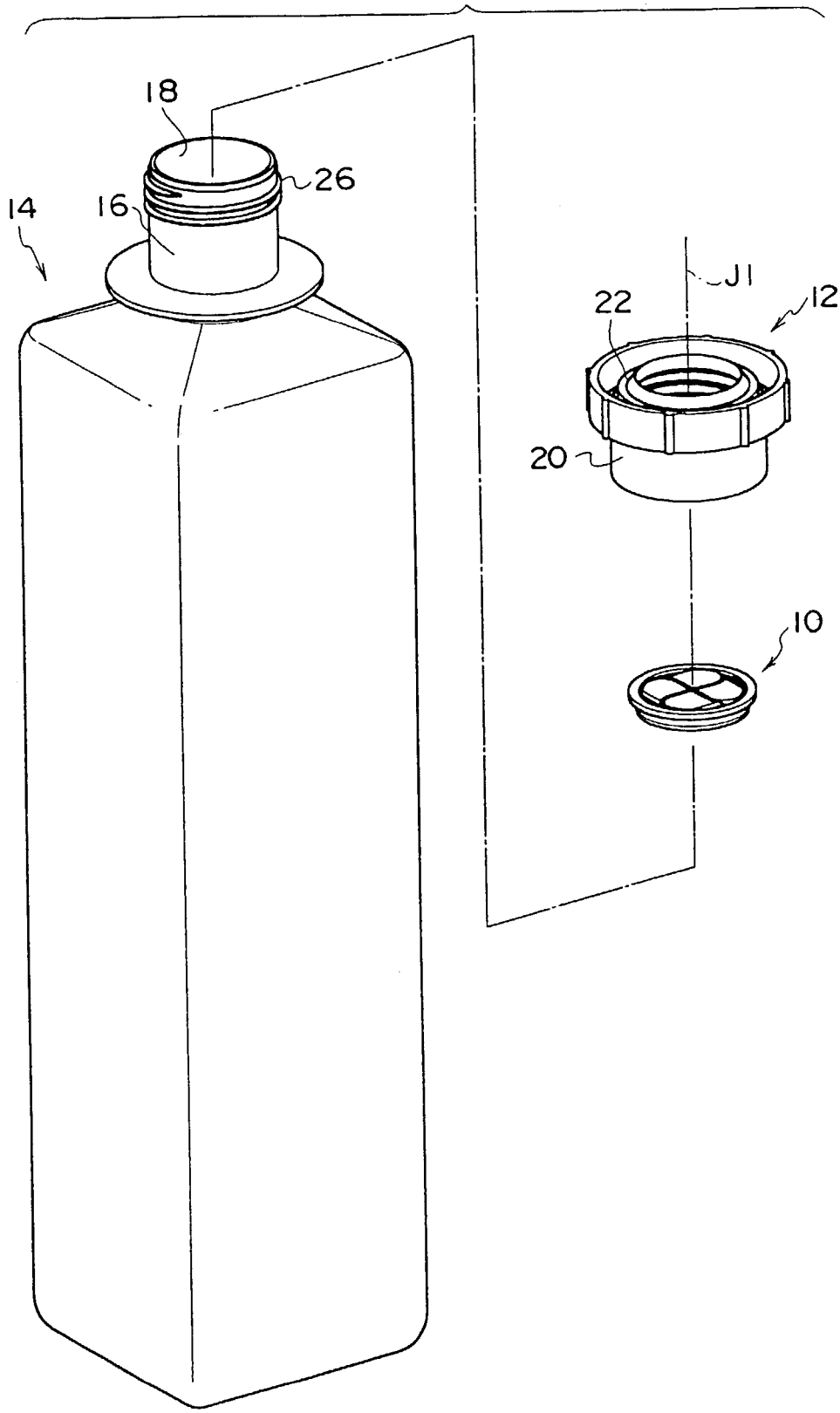
FIG. 1 is an exploded perspective view illustrating a packing according to a first embodiment of the present invention, a cap in which this packing is mounted, and a container to which the cap is attached.
Figure 2:
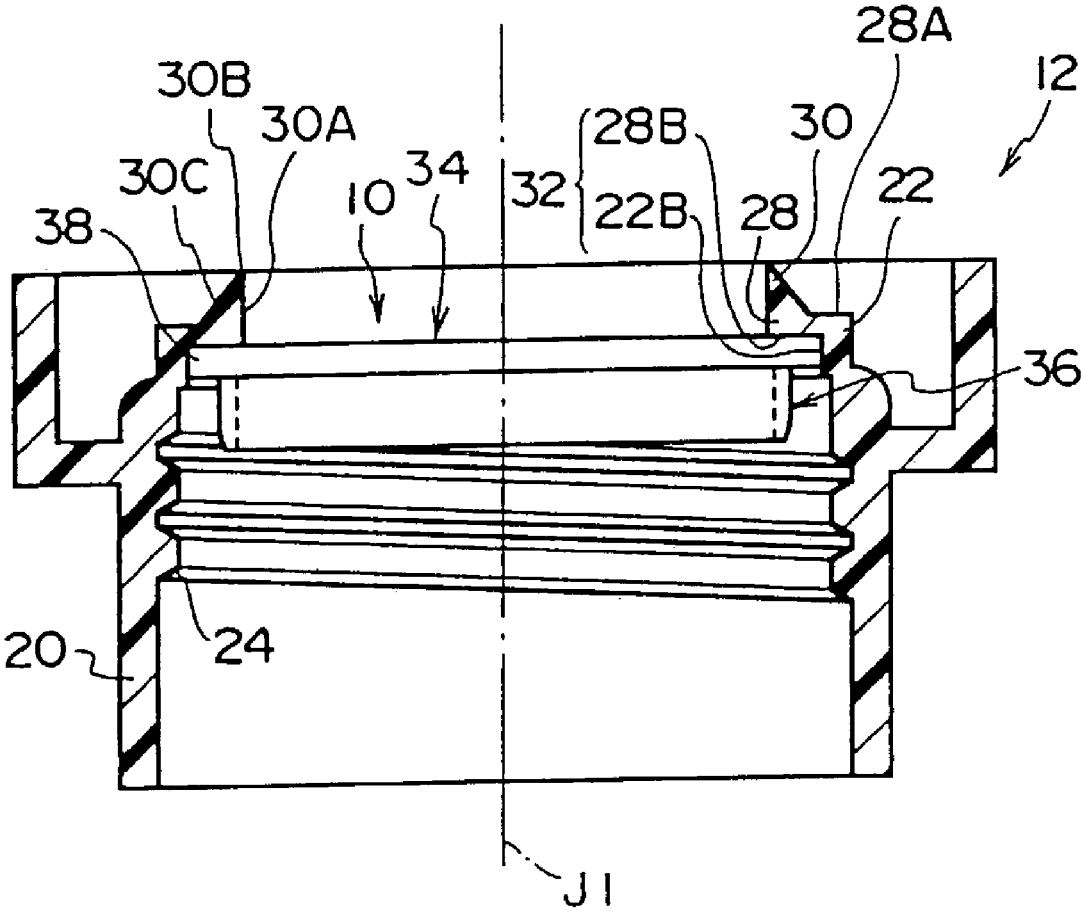
FIG. 2 is a cross sectional view illustrating a state in which the packing according to the first embodiment of the present invention is mounted-in the cap.
Figure 3:
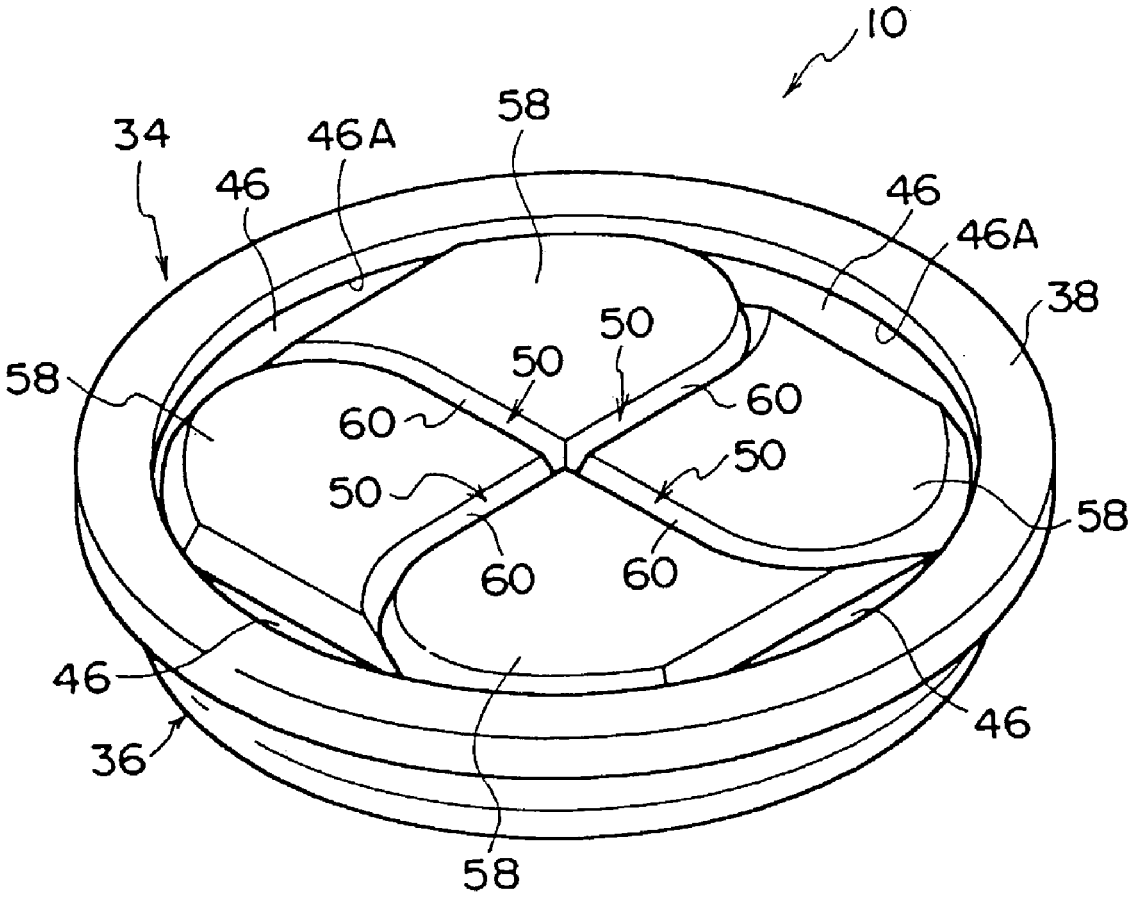
FIG. 3 is a perspective view illustrating the packing according to the first embodiment of the present invention.

A packing 10, a cap 12 in which the packing 10 is mounted, and a photographic processing chemicals container 14 (a container for containing a photographic processing chemicals) to which this cap 12 is attached, according to a first embodiment of the present invention are shown in FIG. 1. Further, the cross section of the cap 12 to which the packing 10 is mounted, and the packing 10 are shown in FIGS. 2 and 3, respectively. The photographic processing chemicals container 14 which is shown in FIG. 1 contains therein photographic processing chemicals, and is an example of a container whose draining port 18 is plugged by the cap 12, in which the packing 10 is mounted, being attached thereto.

The entire body of this photographic processing chemicals container 14 is formed in a substantially rectangular cylindrical shape, and a cylindrically-shaped portion 16 is formed at one end of the container 14 in the axial direction thereof (at the upper end in FIG. 1). One end of the cylindrical portion 16 is used as a draining port 18, and it is possible to drain the photographic processing chemicals which are contained in the photographic processing chemicals container 14 from this draining port 18.

As shown in FIGS. 1 and 2, the cap 12 in which the packing 10 is mounted, comprises an attachment cylindrical portion 20 which is formed in a substantially cylindrical shape, and an anchoring cylindrical portion 22 which is formed integrally with one axial end of the attachment cylindrical portion 20 (at the upper end in FIG. 2) and whose diameter is smaller than the attachment cylindrical portion 20.

As shown in FIG. 2, a female thread 24 is formed on the internal circumferential surface of the attachment cylindrical portion 20. The female thread 24 is screwed onto a male thread 26 (see FIG. 1) which is formed on the external circumferential surface of the cylindrical portion 16 of the photographic processing chemicals container 14. Accordingly, the cap 12 is screwed onto the cylindrical portion 16 and can be attached to the draining port 18.

An annular ring 28 is formed integrally with the anchoring cylindrical portion 22 at one end in the axial direction thereof (the upper end in FIG. 2) so as to extend toward the inside of the anchoring cylindrical portion 22 in the radial direction. A packing mounting portion 32 in which the packing 10 is mounted is formed by the internal surface 22B of the anchoring cylindrical portion 22 and the bottom surface 28B of the ring 28.

In the state in which the packing 10 is mounted in the packing mounting portion 32, a clearance of a predetermined distance is formed between the external circumferential surface of an insertion cylindrical portion 36 and the internal circumferential surface of the attachment cylindrical portion 20. When the cap 12 is screwed onto the cylindrical portion 16 of the photographic processing chemicals container 14, and is attached to the draining port 18, the upper portion of the cylindrical portion 16 enters into the aforementioned clearance. As a result, the insertion cylindrical portion 36 is inserted into the draining port 18 (at the inside of the cylindrical portion 16) with no clearance. Accordingly, the external circumferential surface of the insertion cylindrical portion 36 and the internal circumferential surface of the cylindrical portion 16 contact with each other, and the position of the packing 10 in the radial direction of the photographic processing chemicals container 14 is fixed. Further, since the outer edge of a sealing disc portion 34 is nipped between the bottom surface 28B of the ring 28 and the upper surface of the cylindrical portion 16, the position of the packing 10 in the axial direction of the photographic processing chemicals container 14 is fixed. Moreover, in this state, when the cap 12 in which the packing 10 is mounted is attached to the draining port 18, the draining port 18 is plugged by the packing 10.

A protruding wall 30 is formed so as to protrude from the top surface 28A of the ring 28 over the entire circumference of the ring 28.

The cross section of the protruding wall 30 is formed in a substantially triangular shape having a guiding surface 30A and a sloping surface 30C. As seen from the cross section, the guiding surface 30A is parallel with axis J1. The sloping surface 30C extends from a protruding tip 30B towards the radial external side of the ring 28 as it approaches the top surface 28A of the ring 28. By forming the protruding wall 30 having the configuration described above so as to protrude from the top surface 28A, then in a state where the draining port 18 faces downward, and the photographic processing chemicals container 14 is held such that the axis J1 corresponds to the vertical direction of the photographic processing chemicals container 14 (see FIGS. 8 and 9B), the sloping surface 30C rises toward the radial external side. Accordingly, when a liquid material is contained in the photographic processing chemicals container 14, then even if the draining port 18 faces downward and the material contained in the photographic processing chemicals container 14 flows out due to gravity, the material rises the sloping surface 30C due to surface tension or the like as it empties out and, as a result, the material does not drain in the radial external direction of the photographic processing chemicals container 14.

Figure 4A:
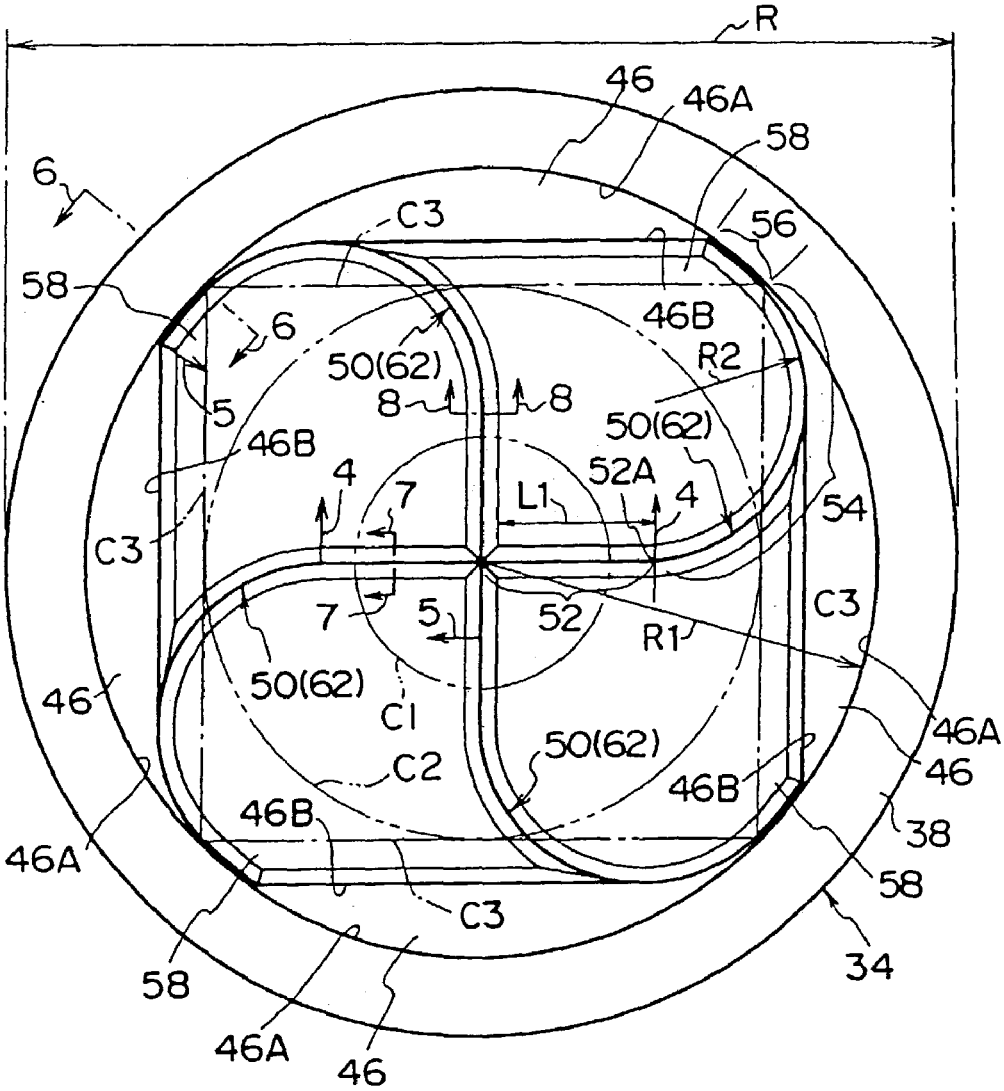
FIG. 4A is a plan view illustrating the packing according to the first embodiment of the present invention.
Figure 4B:
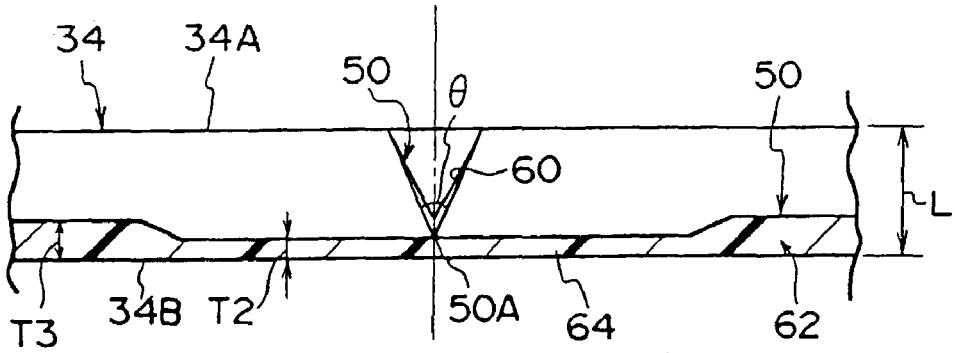
FIG. 4B is a cross sectional view taken along the line IV—IV in FIG. 4A and illustrates the packing according to the first embodiment of the present invention.

The packing 10 is formed from unfoamed resin. The resin contains 50% or more of low density polyethylene (LDPE) whose density range is determined to be between 0.910 and 0.929 (g/cm$^3$) in JIS K 6748-1982, or similarly, 50% or more of high density polyethylene (HDPE) whose density range is determined to be equal to or more than 0.942 (g/cm$^3$) in JIS K 6748-10.982. As shown in FIGS. 3, 4A and 4B in more detail, the packing 10 is formed by the sealing disc portion 34 and the insertion cylindrical portion 36 which are formed integrally with each other. The sealing disc portion 34 is formed in a substantially disc shape having a constant thickness L. The insertion cylindrical portion 36 is formed in a flattened cylindrical shape and extends perpendicularly to the sealing disc portion 34 from a portion adjacent to the external circumference of the rear surface 34B of the sealing disc portion 34. The radial external side portion of the insertion cylindrical portion 36 functions as a flange 38. The flange 38 has a constant thickness L, and imparts a predetermined strength to the sealing disc portion 34. Further, the outer diameter R of the sealing disc portion 34 (see FIG. 4A) ranges from not less than 0.5 cm to not more than 5 cm, and the sealing disc portion 34 has a predetermined strength.

As shown in FIGS. 4A and 4B, by decreasing the thickness of the sealing disc portion 34 in portions (to a thickness T2, see FIG. 6), a plurality of arcuate thin portions 46 (four in the present embodiment), each of which is formed in a substantially arcuate shape as seen from a plan view, are formed on the surface 34A of the sealing disc portion 34 at a predetermined distance from each other in the circumferential direction. Circular arc portions 46A of the arcuate thin portions 46 correspond to the internal circumference of the flange 38.

As shown in FIGS. 4A and 4B, grooves 50 are formed on the surface 34A of the sealing disc portion 34. The grooves 50 are formed by a plurality of radial grooves 52, curved grooves 54, and circumferential grooves 56. The plurality of radial grooves 52 (four in the present embodiment) extend linearly from the center of the surface 34A of the sealing disc portion 34 toward the external circumference of the sealing disc portion 34 (toward the center of each of the arcuate thin portions 46). Each of the curved grooves 54 continues on from the extending end 52A of each of the radial grooves 52 and curves in a smooth circular arc without deviation in the same direction and at a constant angle of curvature with the same central angle. Each of the circumferential grooves 56 extends without deviation from the tip end of each of the curved grooves 54 along the external circumference of the sealing disc portion 34 so as to form a smooth circular arc shape. A portion between the grooves 50 adjacent to each other is a fan portion 58 which is formed in a substantially fan shape having a thickness L which is the same as the flange 38.

As shown in FIGS. 4B, 7A, 7B, and 18A in more detail, each of the grooves 50 is cut diagonally from the surface 34A to the rear surface 34B of the sealing disc portion 34 so as to form a substantially V-shaped cross section having a pair of sloping surfaces 60. The angle θ formed by the sloping surfaces 60 has a predetermined angle which is more than 0° and equal to or less than 120°. The distance between the sloping surfaces 60 gradually decreases from the surface 34A to the rear surface 34B, of the sealing disc portion 34. By forming this groove 50, a thin portion 62 having a predetermined thickness T3 is formed between a bottom end 50A of the groove 50 and the rear surface 34B of the sealing disc portion 34.

The length L1 of each of the radial grooves 52 has a predetermined, length such that the tip end 52A of the radial groove 52 does not extend to the arcuate thin portion 46 (i.e., the length of the radial groove portion 52 is smaller than the radius of the sealing disc portion 34). More specifically if the internal circumference of the flange 38 (a circle which is formed by the circular arc portions 46A of the arcuate thin portions 46) is R1, then preferably, $$0 \leqq L1 \leqq (4/5) \times R1$$

from a standpoint of perforation performance (splittability of the groove 50) which will be described later, and more preferably, $$(1/5) \times R1 \leqq L1 \leqq (2/3) \times R1.$$

Moreover, in the case of L1=0, it means that there are no linear radial grooves 52, and the curved grooves 54 are formed so as to extend directly from the center of the sealing disc portion 34. Accordingly, these curved grooves 54 equate to both the radial portions and the curved portions of the present invention. In the packing 10 according to the present embodiment, R1=13 mm, and L1=5 mm.

Figure 5:
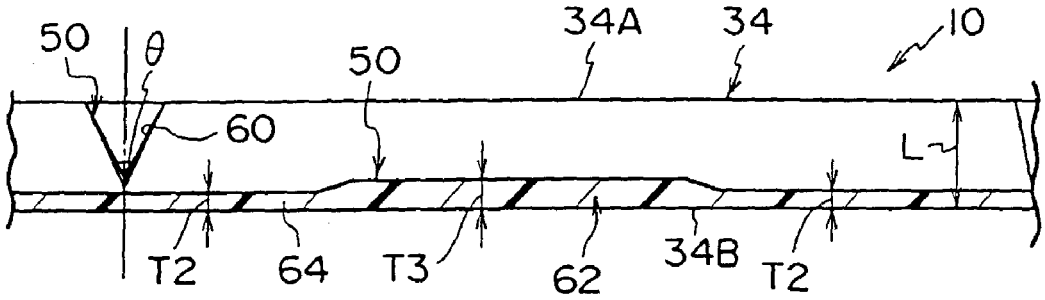
FIG. 5 is a cross sectional view taken along the line V—V in FIG. 4A and illustrates the packing according to the first embodiment of the present invention.

As shown in FIGS. 4A, 4B, and 5, a low strength portion 64 is formed on each of the radial grooves 52 within a predetermined range from the center of the sealing disc portion 34 (within the range indicated by a double-dashed line C1 in FIG. 4A), by not changing the width W of the upper end of the radial groove 52 (see FIGS. 7A and 7B), but by deeply cutting the radial groove 52 (accordingly, the inclination angle θ formed by the sloping surfaces 60 is made smaller) thus further decreasing the thickness of the thin portion 62 (thickness T2).

The thickness T2 of the low strength portion 64 is set to range from not less than 0.05 mm to not more than 0.7 mm. Further, the thickness T2 is set such that the ratio of the plate thickness L of the sealing disc portion 34 to the thickness T2 of the low strength portion 64 (L/T2) is 2 or more.

As shown in FIG. 4A, the curved grooves 54 are curved in a circular arc shape, continuing on from the tip ends 52A of the radial grooves 52 in the same direction (in the clockwise direction in FIG. 4A in the present embodiment), at a predetermined radius of curvature R2, and at a predetermined central angle. Each of the curved grooves 54 contacts with a chord portion 46B (a straight line portion) of each of the arcuate thin portions 46, and gradually extends toward the external circumference of the sealing disc portions 34.

The radius of curvature R2 of the curved groove 54 is appropriately determined from a standpoint of perforation performance or the like which will be described later. However, preferably, $$R1/5 \leqq R2,$$

and more preferably, $$R1/5 \leqq R2 \leqq R1/2.$$

In the packing 10 according to the present embodiment, R2=5 mm.

If the curved groove 54 is thought of as being divided into micro portions, in these micro portions, it is not necessary to maintain the radius of curvature R2 constant. The respective micro portions may have different radii of curvature R2 or a portion thereof may be formed by a straight line connecting internal portions of the arc provided that the smoothness of the curved groove 54 as a whole is not lost.

Figure 6:
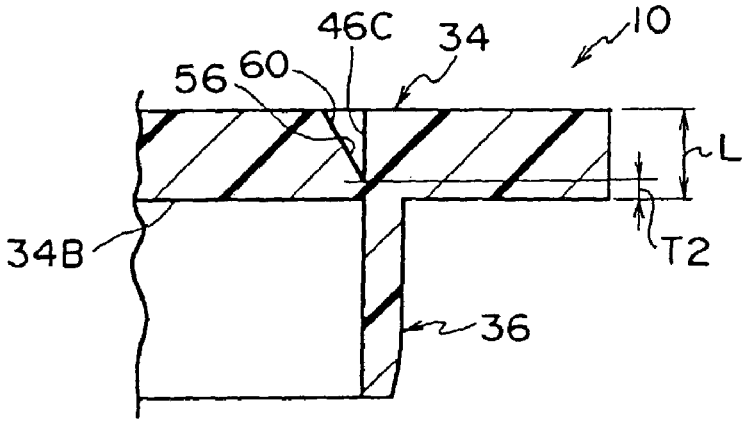
FIG. 6 is a cross sectional view taken along the line VI—VI in FIG. 4A and illustrates the packing according to the first embodiment of the present invention.
Figure 7A:
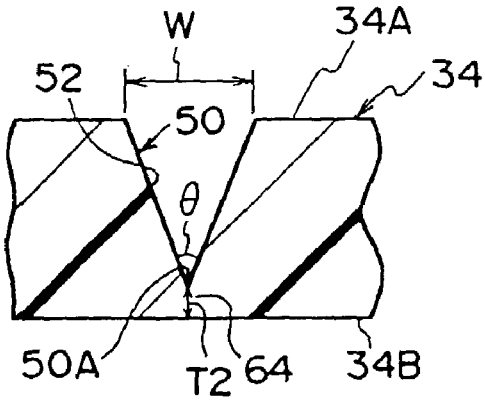
FIG. 7A is a cross sectional view taken along the line VII—VII in FIG. 4A and illustrates the packing according to the first embodiment of the present invention.
Figure 7B:
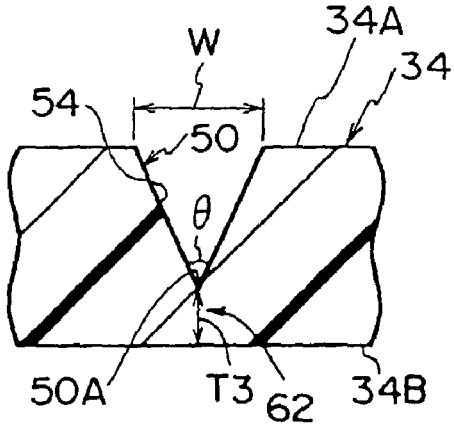
FIG. 7B is a cross sectional view taken along the line VIII—VIII in FIG. 4A and illustrates the packing according to the first embodiment of the present invention.

As shown in FIGS. 5, 6 and 7B, the strength of the thin portion 62 of each of the curved grooves 54 is made to be much lower at a portion of the, sealing disc portion 34 outside a predetermined range from the center of the sealing disc portion 34 (outside the range indicated by the double-dashed line C2 in FIG. 4A) without changing the width W of the upper end of the curved groove 54, by deeply cutting the curved groove 54 and thereby decreasing the thickness of the thin portion 62 (thickness T2).

Either one of the pair of sloping surfaces 60 which are shown in FIGS. 7A and 7B is not formed at a portion at which the curved groove 54 is formed along the chord portion 46B of the arcuate thin portion 46. However, in this portion also, the thickness of the arcuate thin portion 46 is T2 so that, essentially, the curved groove 54 is formed.

As shown in FIG. 6, the circumferential grooves 56 extend from the respective tip ends of the curved grooves 54 along the external circumference of the sealing disc portion 34. The circumferential grooves 56 are different from the radial grooves 52 and the curved grooves 54 in that each of the circumferential grooves 56 is formed by a single sloping surface 60 extending from the surface 34A to the rear surface 34B of the sealing disc portion 34, and by a vertical surface portion 46C which forms the circular arcuate portion 46A of the arcuate thin portion 46. The thin portions 62 having the same thickness T2 as the arcuate thin portions 46 are formed by the circumferential grooves 56. Accordingly, as can be seen from an overall view of the grooves 50 in FIGS. 4A, 4B, and 5, the low strength portion 64 in which the thickness of the thin portion 62 is decreases even further (thickness T2) is formed within the range from the center of the sealing disc portion 34 to the double-dashed line C1. Within the range between the double-dashed line C1 and the double-dashed line C2, the thickness of the thin portion 62 is not decreased any more (thickness T3) so that a constant strength can be maintained. Outside the range indicated by the double-dashed line C2, the thickness of the thin portion 62 is decreased once more (thickness T2).

Next, a description of a direction in which photographic processing chemicals are drained from the photographic processing chemicals container 14 whose draining port 18 is plugged by the packing 10 according to the present embodiment, and an operation of the packing 10 will be given.

Figure 8:
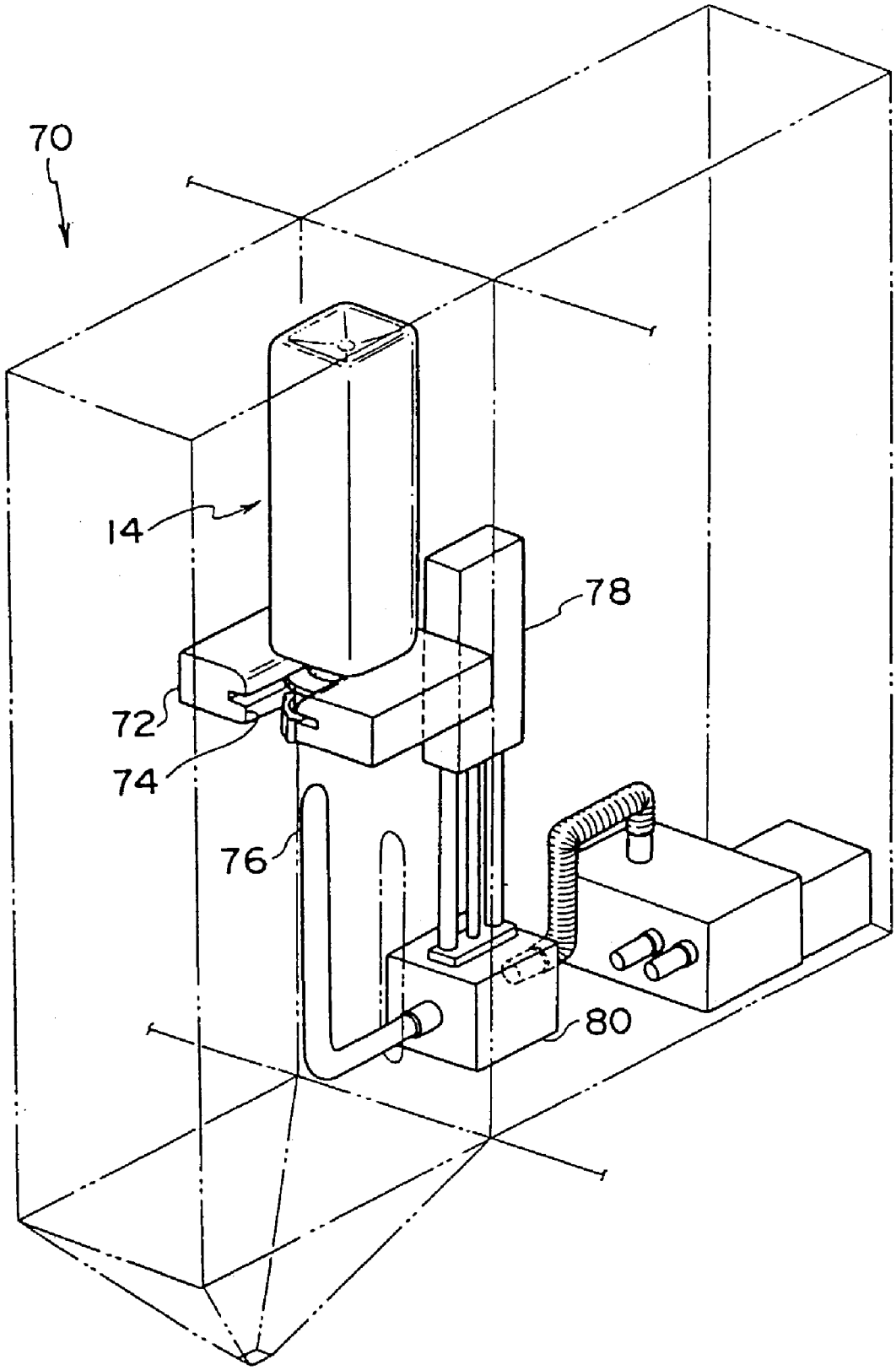
FIG. 8 is a perspective view illustrating a schematic structure of photographic processing chemicals supplying device which supplies photographic processing chemicals from the container whose draining port is plugged by the packing according to the first embodiment of the present invention.

A photographic processing chemicals supplying device 70 in the automatic developer is schematically shown in FIG. 8. When the photographic processing chemicals container 14 is set in the photographic processing chemicals supplying device 70, the photographic processing chemicals are supplied from the container 14.

Figure 9A:
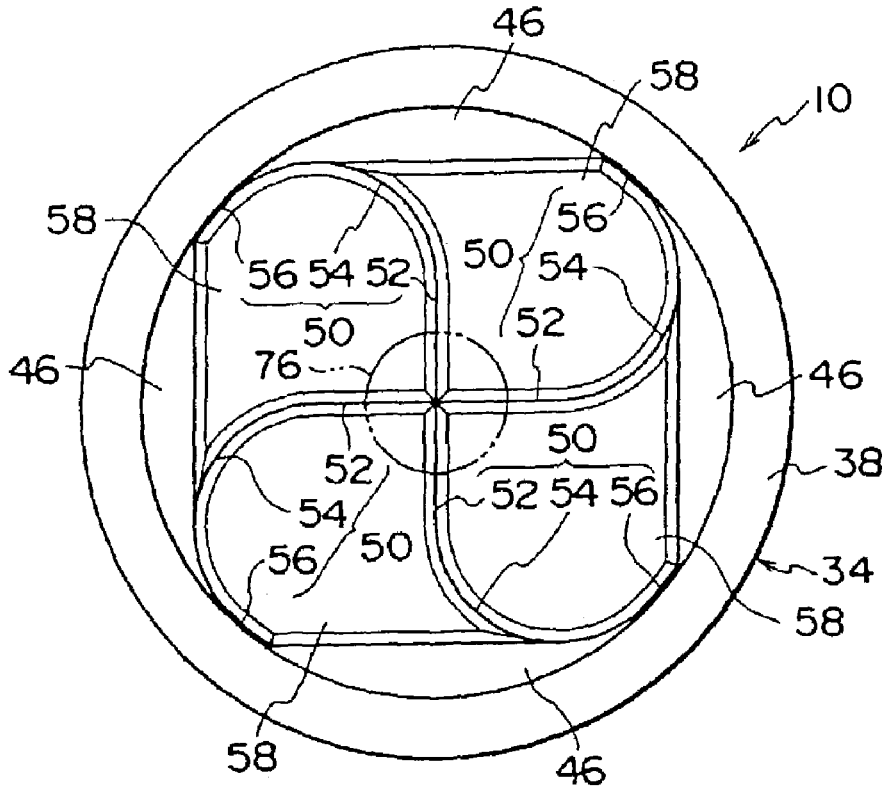
FIG. 9A is a plan view of the packing and illustrates the vicinity thereof in the state in which the container is set in the photographic processing chemicals supplying device which is shown in FIG. 8.
Figure 9B:
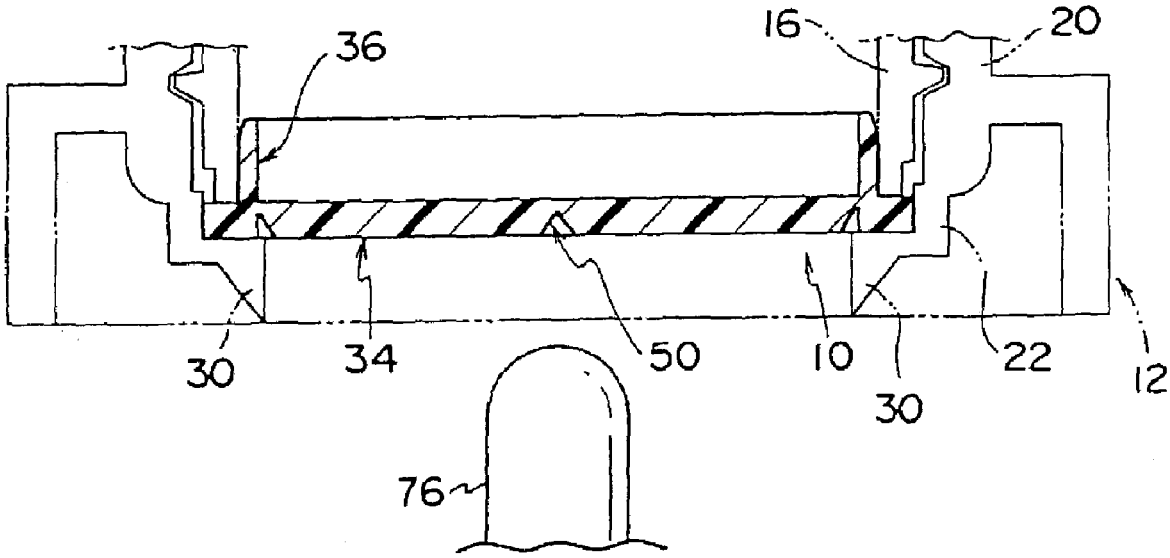
FIG. 9B is a cross sectional view of the packing and illustrates the vicinity thereof in the state in which the container is set in the photographic processing chemicals supplying device which is shown in FIG. 8.

In order to supply the photographic processing chemicals from the photographic processing chemicals container 14 into the automatic developer, as shown in FIG. 8, firstly, the photographic processing chemicals container 14 is inserted into a holding hole 74 of a holding plate 72 and set upside down. The photographic processing chemicals container 14 is held above a replenishing tank (not shown) in a state where the draining port 18 (see FIG. 1) faces downward. At this time, because the draining port 18 of the photographic processing chemicals container 14 is plugged by the packing 10, the photographic processing chemicals does not flow out inadvertently from the photographic processing chemicals container 14. Further, as shown in FIG. 9B, the upper end of a perforating pipe 76 which is provided in the photographic processing chemicals supplying device 70 is positioned beneath the packing 10 plugging the draining port 18.

Next, an unillustrated controller rotates a pinion inside a driving portion 78 and raises an elevating portion 80. The perforating pipe 76 extending from the elevating portion 80 is thereby raised, and the tip end of the perforating pipe 76 pushes up the central portion of the packing 10 which plugs the draining port 18.

Figure 10A:
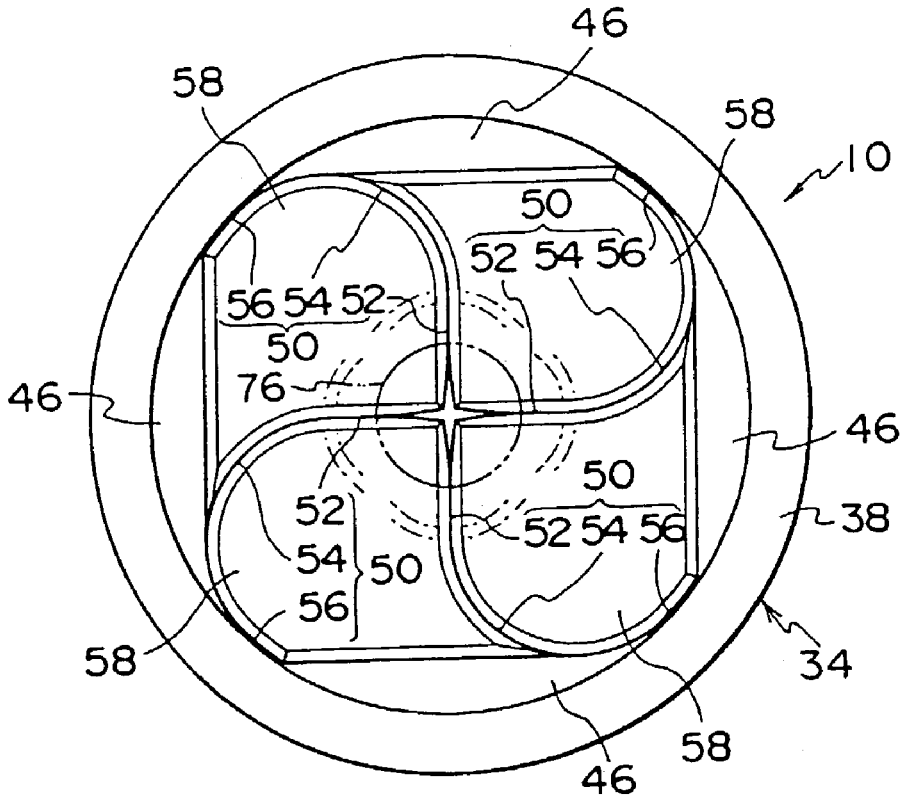
FIG. 10A is a plan view of the packing and illustrates a state during the breaking of the packing by the photographic processing chemicals supplying device which is shown in FIG. 8.
Figure 10B:
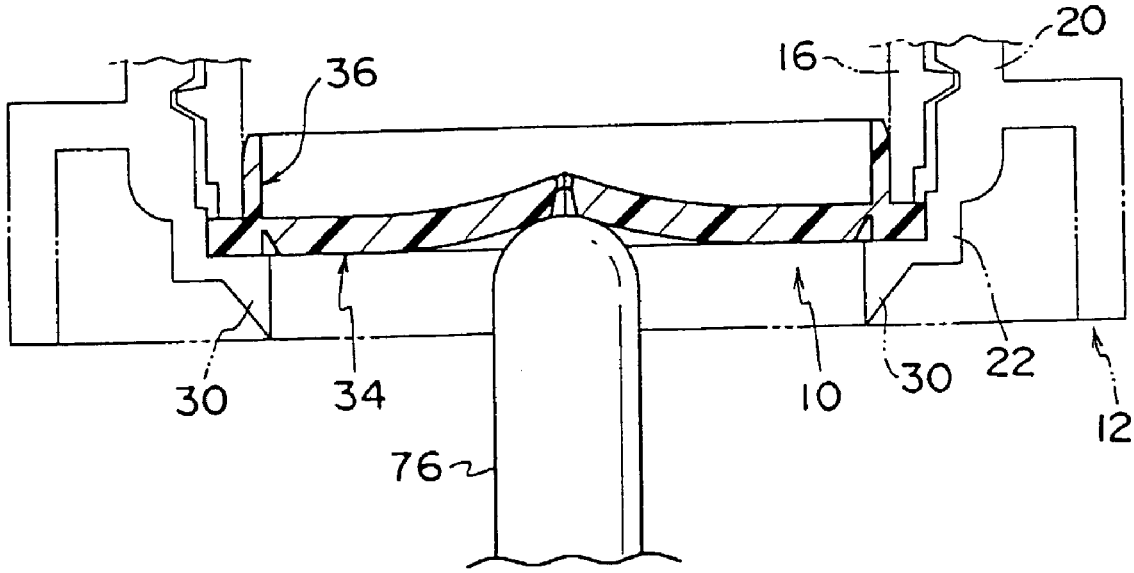
FIG. 10B is a cross sectional view of the packing and illustrates a state during the breaking of the packing by the photographic processing chemicals supplying device which is shown in FIG. 8.

As shown in FIGS. 10A and 10B, when the center of the packing 10 is pressed up by the tip end of the perforating pipe 76, in the vicinity of the center of the sealing disc portion 34, the tensional force acts upon the fan portions 58, which are provided on both side portions of each of the radial grooves 52 (see FIG. 4) which form the grooves 50, in the direction in which the fan portions 58 are separated from each other.

Generally, when a member with a fixed thickness is pressed in the direction of that thickness and is broken, the maximum amount of pressing force (perforation force) is needed at the initial stage of the pressing, i.e., immediately before and after perforation starts. In the packing 10 according to the present embodiment, among the thin portions 62, low strength portions 64 are formed at portions of the thin portions 62 within the range indicated by the double-dashed line C1 in FIG. 4, and the strength thereof is weakened. Accordingly, even if the force for elevating the perforating pipe 76 is small, in other words, even if the rotational torque of the pinion of the driving portion 78 is small, the sealing disc portion 34 can be broken along the radial grooves 52. Namely, the thin portions 62 in the vicinity of the central portion of the sealing disc portion 34 can be split with a small amount of pressing force. Accordingly, the sealing disc portion 34 can be broken along the thin portions 62.

Figure 11A:
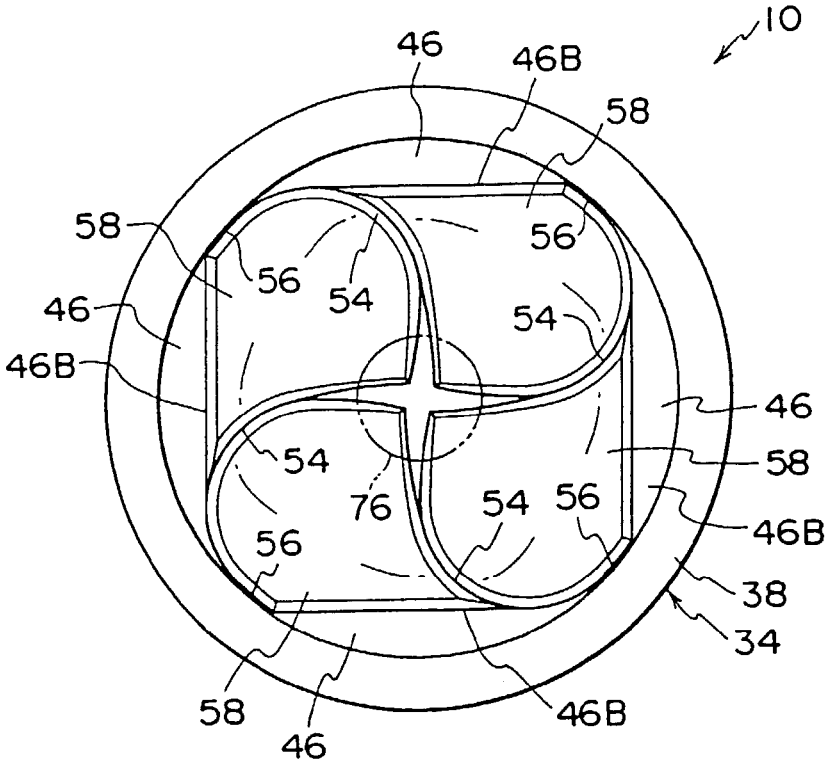
FIG. 11A is a plan view of the packing and illustrates a state during the breaking of the packing by the photographic processing chemicals supplying device which is shown in FIG. 8.
Figure 11B:
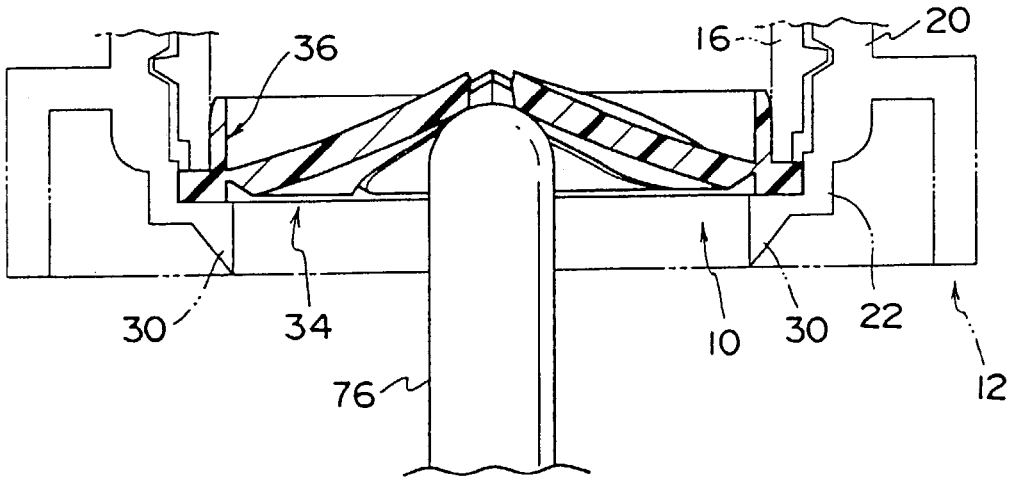
FIG. 11B is a cross sectional view of the packing and illustrates a state during the breaking of the packing by the photographic processing chemicals supplying device which is shown in FIG. 8.

As shown in FIGS. 11A and 11B, when the perforating pipe 76 is further raised, the splits extend to the external side of the sealing disc portion 34 in the radial direction thereof, and further extend to the thin portions 62 which are formed by the curved grooves 54 (see FIG. 4A). During this splitting process, the splits extend from the low strength portion 64 to a portion of the thin portion 62 at which the low strength portion 64 is not formed (within the range between the double-dashed line C1 and the double-dashed line C2 in FIG. 4A). However, at this time, since splits have already been formed on the sealing disc portion 34, these splits can be expanded with a small amount of pressing force.

As can be seen from FIG. 4A, since the curved grooves 54 continue on from the radial curved grooves 52 without deviation, and are curved at a constant radius of the curvature, the tensional force acts upon the fan portions 58 which are provided on both sides of each of the curved grooves 54 in the direction where the fan portions 58 are forced to separate from each other. As a result, the splits extend smoothly toward the external side portion of the sealing disc portion 34 in the radial direction thereof along the curved grooves 54.

Among the thin portions 62 which are formed by the curved grooves 54, the thickness of a portion of each of the thin portions 62 outside the range indicated by the double-dashed line C2 in FIG. 4A is decreased again (thickness T2), and the strength thereof is made low. For this reason, when the splits extend to these low strength portions, the sealing disc portion 34 is broken with a smaller amount of pressing force. Especially when the splits extend to the chord portions 46B of the arcuate thin portions 46, only the fan portion 58 on one side of each of the thin portions 62 is pulled away from the arcuate thin portion 46. However, even in this case, the splits expand along the low strength portions of the thin portions 62 which are formed by the curved grooves 54, and extend to the thin portions 62 which are formed by the circumferential grooves 56.

Figure 12A:
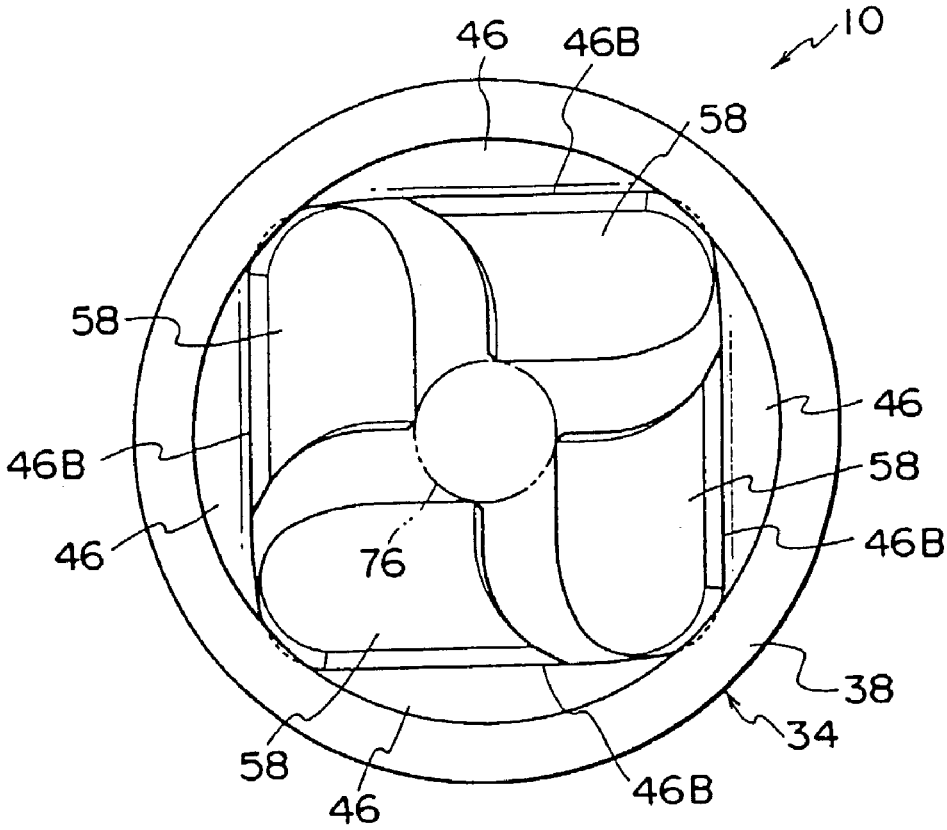
FIG. 12A is a plan view of the packing and illustrates a state in which the packing is broken by the photographic processing chemicals supplying device which is shown in FIG. 8.
Figure 12B:
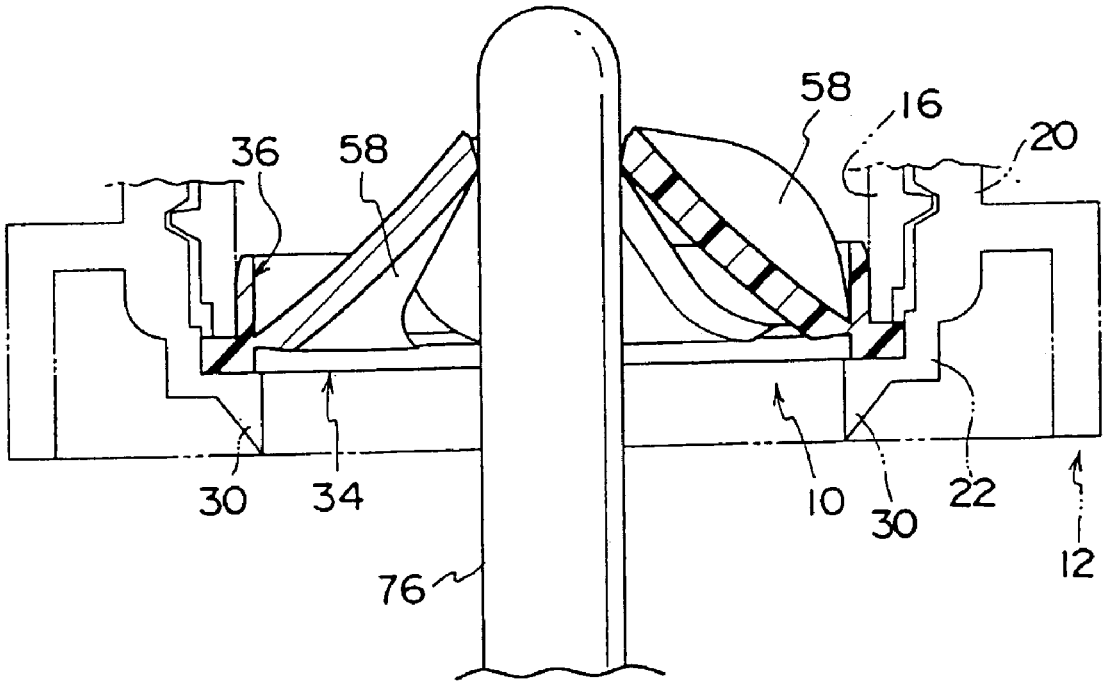
FIG. 12B is a cross sectional view of the packing and illustrates a state in which the packing is broken by the photographic processing chemicals supplying device which is shown in FIG. 8.
Figure 13:
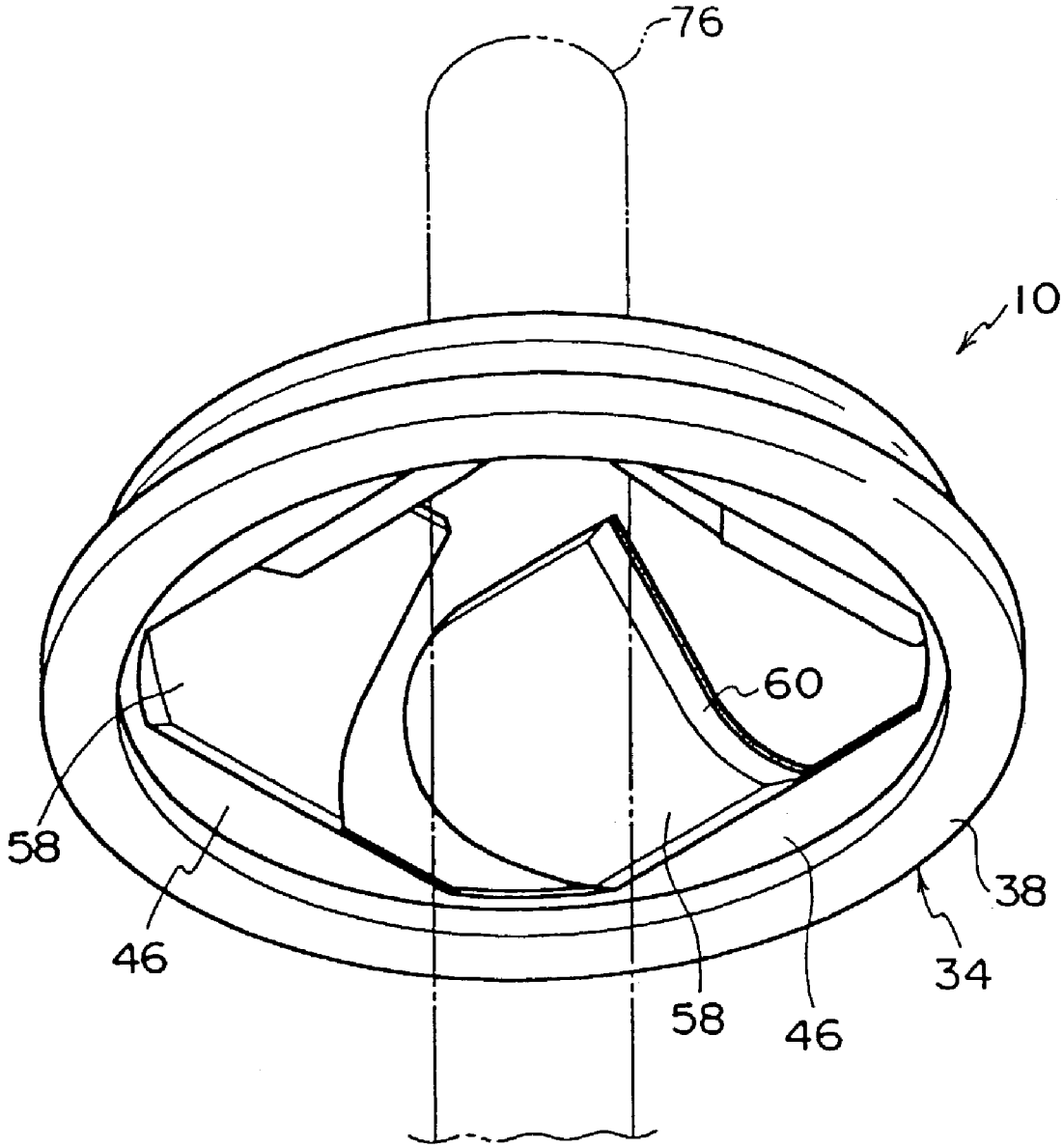
FIG. 13 is a perspective view illustrating a state in which the packing is broken by the photographic processing chemicals supplying device which is shown in FIG. 8.

When splits further expand along the thin portions 62, and the sealing disc portion 34 is broken, because the thin portions 62 (the circumferential grooves 56) are formed along the external circumference of the sealing disc portion 34, as shown in FIGS. 12A and 12B, each of the fan portions 58 is thereby bent at the chord portion 46B of the arcuate thin portion 46. Namely, as is also shown in FIG. 13, the sealing disc portion 34 is opened and the area of the opening is made wider (in contrast to this, for example, when the circumferential groove 56 is not formed on the sealing disc portion 34, since the fan portion 58 is bent along the line indicated by the double-dashed line C3 which is shown in FIG. 4A, the area of the opening of the sealing disc portion 34 is made narrower).

In this way, in the packing 10 according to the present embodiment, curved grooves 54, which continue on smoothly without deviation from the radial grooves 52, and circumferential grooves 56, which continue on smoothly without deviation from the curved grooves 54 along the external circumference of the sealing disc portion 34, are formed on the sealing disc portion 34 for plugging the draining port 18 of the photographic processing chemicals container 14. As a result, the sealing disc portion 34 can be opened wide with a small amount of pressing force.

In the packing 10 according to the present embodiment, since the low strength portions 64 are formed at portions within a predetermined range from the center thereof (within the range indicated by the double-dashed line C1 which is shown in FIG. 4A) of the thin portions 62 which are formed on the sealing disc portion 34 as compared to the packing in which the strength of these portions is not reduced, the sealing disc plate 34 is broken with a smaller amount of pressing force, and the draining port 18 of the photographic processing chemicals container 14 can thereby be opened.

Further, because the strength at portions of the thin portions 62 within the range between the double-dashed line C1 and the double-dashed line C2 is not reduced, the sealing disc portion 34 maintains a constant strength. Accordingly, due to, for example, a change or the like of the internal pressure of the photographic processing chemicals container 14, even if the sealing disc portion 34 is pressed outwardly or inwardly of the photographic processing chemicals container 14, the sealing disc portion 34 is not broken unexpectedly. Especially when the photographic processing chemicals container 14 is dropped, the internal pressure of the container 14 may increase temporarily, however, even in this case, the sealing disc portion 34 is not broken.

In the packing 10 according to the present embodiment, since the outer diameter of the sealing disc portion 34 is between not less than 0.5 cm and not more than 5 cm, the sealing disc portion 34 stretches appropriately due to pressing force from the pressing means (however, it does not stretch excessively), the sealing disc portion 34 can be broken with a small amount of pressing force.

As described above, in the packing 10 according-to the present embodiment, opposing properties can be realized, namely, that a predetermined amount of strength is maintained in the sealing disc portion 34, and the pressing force which is needed by the pressing means to perforate this sealing disc portion 34 (i.e., the perforating force of the perforating pipe 76) can be minimized.

A packing 110 according to the second embodiment of the present invention is shown in FIG. 14. In this packing 110, only the configuration of grooves in the second embodiment of the present invention is different as compared to the packing 10 according to the first embodiment of the present invention. Structural parts and members identical to those of the packing 10 according to the first embodiment are denoted by the same reference numerals, and a description thereof will be omitted.

Figure 14A:
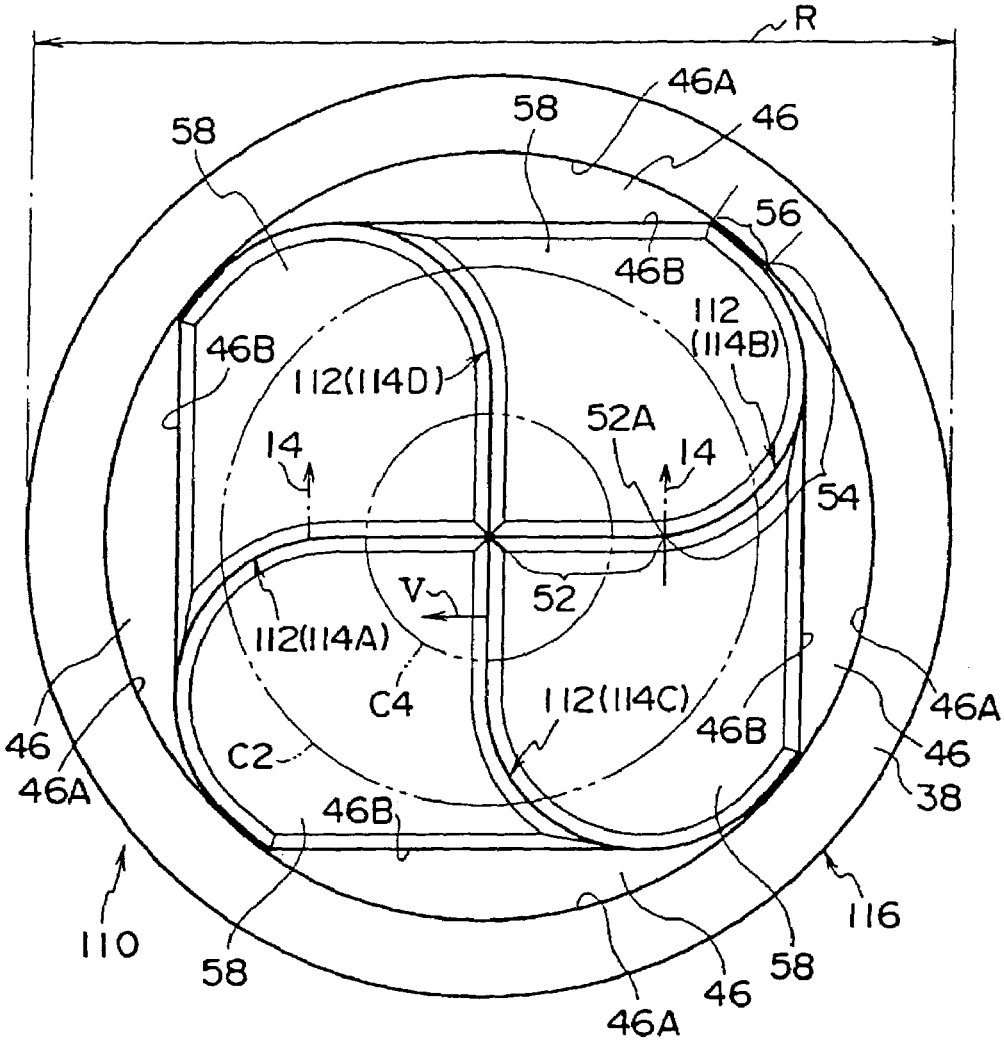
FIG. 14A is a plan view which illustrates a packing according to a second embodiment of the present invention.

In this packing 110, as shown in FIG. 14A, among four thin portions 114A, 114B, 114C, and 114D which are formed by grooves 112, as a whole, the thickness of each of the two thin portions 114A and 114B is smaller than that of each of the other two thin portions 114C and 114D. Namely, the thin portions 114A and 114B are low strength thin portions having a strength which is lower than the other thin portions 114C and 114D.

Figure 15A:
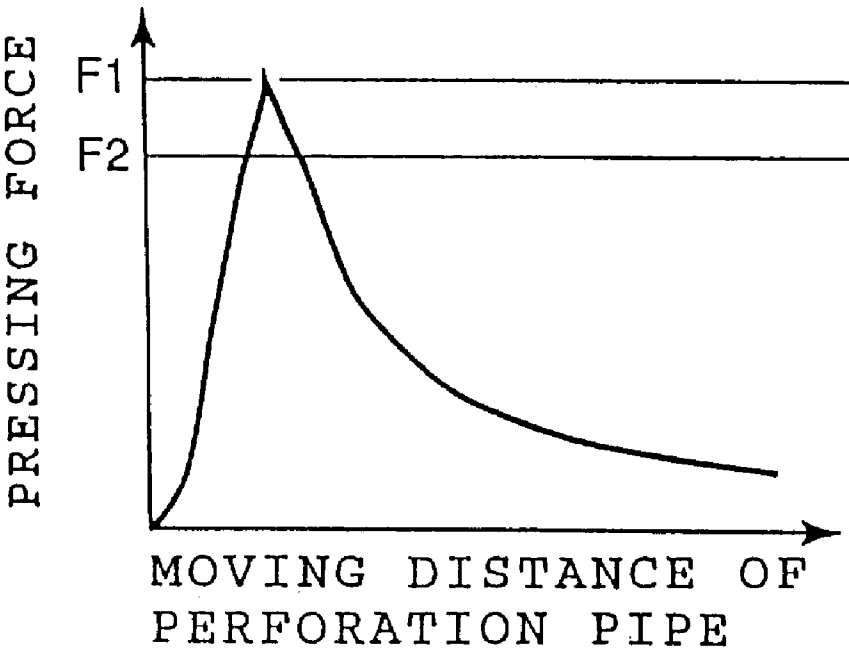
FIG. 15A is a graph illustrating the relationship between the moving distance and the pressing force of a perforating pipe in the case in which a plurality of thin portions of the packing have the same thickness.

Generally, the relationship which is shown in FIG. 15A exists between the length of a split which is formed by the sealing disc portion 116 being pressed by the pressing means (the perforating pipe 76), and the pressing force which is generated by the pressing means and is needed to expand the split. The relationship between the distance moved (on the basis of the distance moved from the tip end of the perforating pipe 76 at the point the tip end contacts with the sealing disc portion) and the pressing force of the perforating pipe 76 is shown in the graph in FIG. 15A. As can be seen from this graph, if the four thin portions have the same thickness, at a stage in which the distance moved by the perforating pipe 76 is small, the pressing force amounts to its maximum value F1 (which is referred to as maximum pressing force, hereinafter). At this point, splits are formed at the thin portions. Once splits are formed on the sealing disc portion 34, only a small amount of pressing force is needed in order to expand the splits. Accordingly, after the pressing force has exceeded the maximum pressing force F1, the pressing force decreases invariably.

Figure 15B:
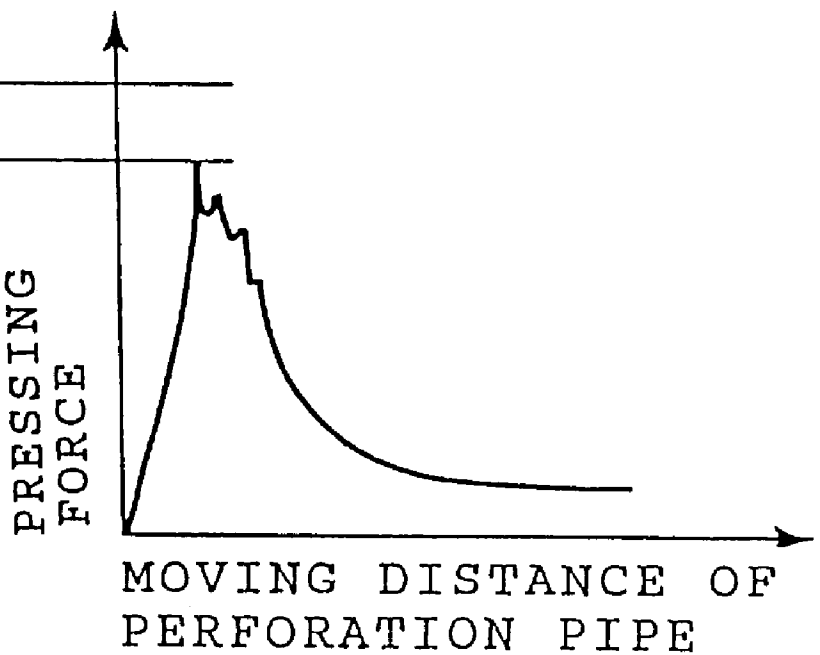
FIG. 15B is a graph illustrating the relationship between the moving distance and the pressing force of a perforating pipe in the case of the packing according to the second embodiment of the present invention.

Conversely, the relationship between the distance moved and the pressing force of the perforating pipe 76 when a sealing disc portion 116 of the packing 110 is pressed and broken by the perforating pipe 76 is shown in FIG. 15B. In the packing 110, since the strength at the thin portions 114A and 114B is made lower than the other thin portions 114C and 114D, the maximum pressing force F2, which is needed to form splits at the thin portions 114A and 114B, is less than the maximum pressing force F1 which is shown in FIG. 15A. Moreover, in the graph of FIG. 15B, as it can be seen from the fact that there are a plurality of maximum values of pressing force, the pressing force acts upon and is dispersed at the four thin portions 114A, 114B, 114C and 114D at different times.

Accordingly, when the center of the sealing disc portion 116 of the packing 110 is pressed by the perforating pipe 76, splits are formed at the thin portions 114A and 114B (the low strength thin portions) and the sealing disc portion 116 is thereby broken. When the splits extend to the portions near the external circumference of the sealing disc portion 116, since the amount of pressing force which is needed to form splits at the thin portions 114A and 114B (see FIG. 15B) is small, splits extend to the other thin portions 114C and 114D as well. The sealing disc portion 116 is thus entirely broken, and the draining port 18 (see FIG. 1) is opened.

Among the four thin portions 114A, 114B, 114C and 114D, by making the two thin portions 114A and 114B low strength portions whose strength is lower than the other thin portions 114C and 114D, the tensional force which acts upon the fan portions 58 adjacent to each other by the pressing force of the pressing means can be dispersed at different times. Accordingly, the sealing disc portion 116 can be broken with a small amount of pressing force. Further, splits can be first induced at the thin portions 114A and 114B by making the thin portions 114A and 114B low strength portions. Accordingly, since the thickness of the other thin portions 114C and 114D can be made relatively larger, it is possible to make the thickness of all four thin portions 114A, 114B, 114C and 114D larger. For this reason, the strength of the sealing disc portion 116 can be kept constant and even when the sealing disc portion 116 is pressed inwardly or outwardly of the photographic processing chemicals container 14, the sealing disc portion 116 does not unexpectedly break.

In order to disperse the tensional force acting upon the fan portions 58 adjacent to each other, it is not necessary to reduce the strength of two of the plurality of thin portions and instead, the strength of one thin portion or three or more of the thin portions may be made to be lower than the other thin portions. Further, when the number of thin portions is equal to or more than three (accordingly, the number of the fan portions 58 is equal to or more than three), the above-described effect which is obtained by forming low strength thin portions (the tensional force acting upon the fan portions 58 is dispersed at different times) can be accomplished.

Figure 14B:
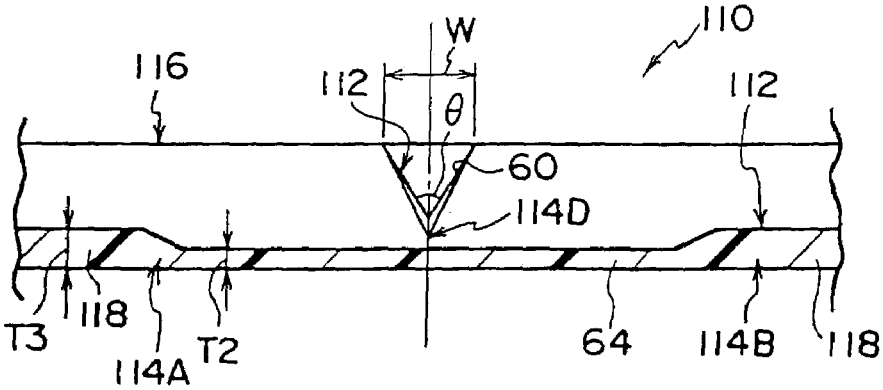
FIG. 14B is a cross sectional view taken along the line XIV—XIV in FIG. 14A and illustrates the packing according to the second embodiment of the present invention.

As shown in FIG. 14B, high strength portions 118 where the thickness of the thin portions 114A, 114B, 114C, and 114D has been increased can be formed outside a predetermined range from the center of the sealing disc portion 116 (outside the range indicated by the double-dashed line C4 in FIG. 14A) by increasing the angle θ (refer to FIGS. 7A and 7B) which is formed by the sloping surfaces 60. By forming these high strength portions 118, splits which are formed at the thin portions 114A and 114B are prevented from extending any more, and thereafter, the thin portions 114C and 114D) which are not formed as low strength portions begin to split. When the splits of the thin portions 114C and 114D reach the high strength portions 118, the four thin portions 114A, 114B, 114C, and 114D are caused to split at the same time, and the sealing disc portion 116 is thereby broken.

By forming the high strength portions 118 at the four thin portions 114A, 114B, 114C, and 114D, it is thereby possible to prevent splits from being formed only at the thin portions 114A and 114B having low strength. Splits can reliably be formed at the four thin portions 114A, 114B, 114C, and 114D so that the sealing disc portion 116 can be broken.

Figure 16A:
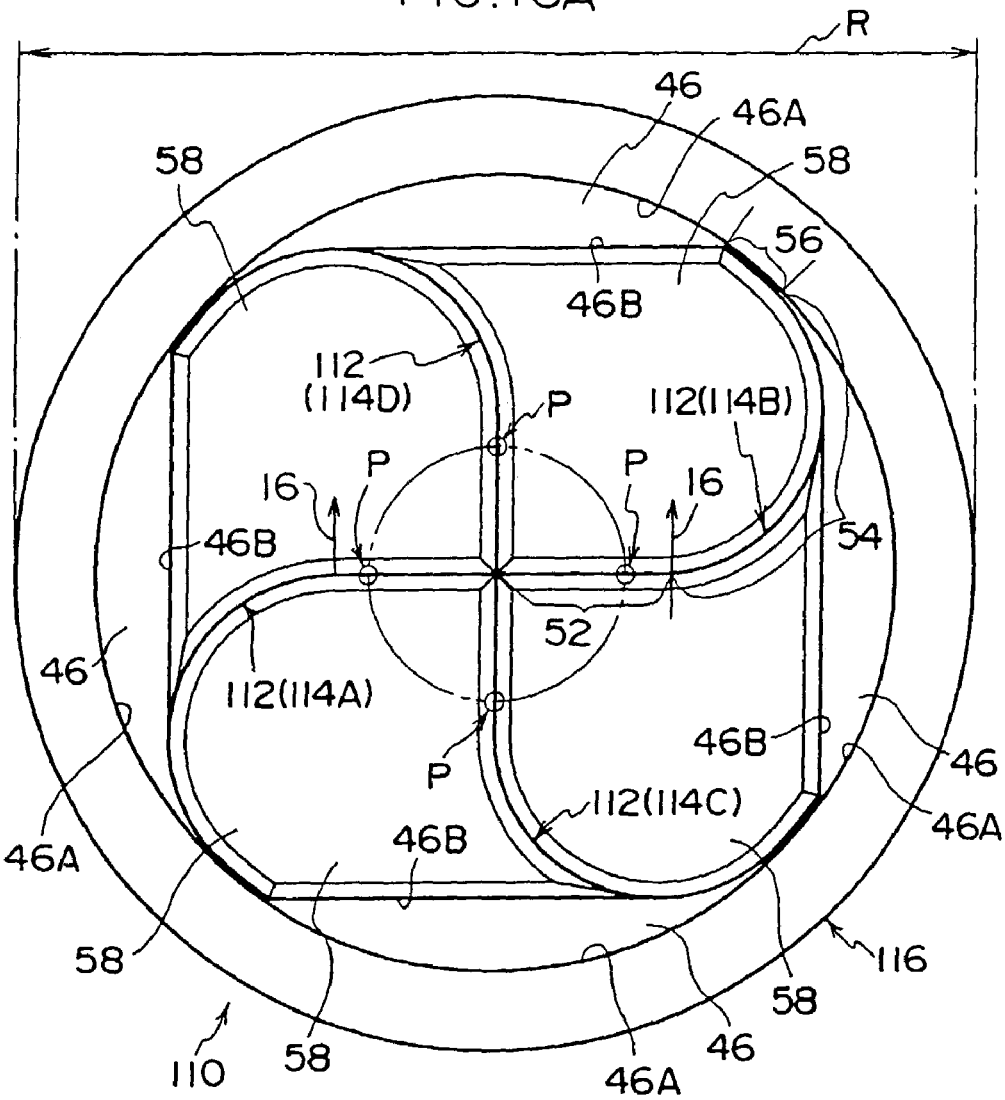
FIG. 16A is a plan view illustrating a packing according to a variant example of the second embodiment of the present invention.
Figure 16B:
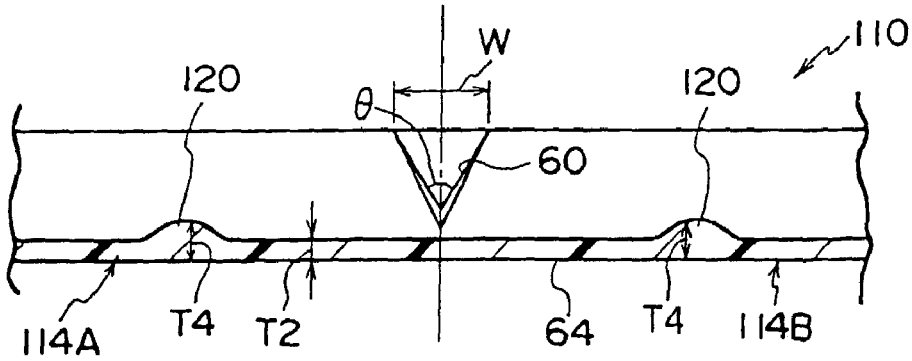
FIG. 16B is a cross sectional view taken along the line XVI—XVI in FIG. 16A and illustrates the packing according to the variant example of the second embodiment of the present invention.

Instead of the high strength portions 118 which are shown in FIG. 14B, as shown in FIGS. 16A and 16B, within the local areas P, each of which is spaced apart from the center of the sealing disc portion 116, the thickness of the thin portions 114A and 114B is made larger (thickness T4) by increasing the angle θ which is formed by the sloping surfaces 60 (see FIGS. 7A and 7B). Within the predetermined area P only, the strength of each of the thin portions 114A, 114B, 114C, and 114D is increased so that high strength portions 120 can be formed. In this way, by forming the high strength portions 120 locally, as compared to the packing 110 having the cross section which is shown in FIG. 14B, after the tip ends of splits have exceeded the high strength portions 120, the splits can extend with a small amount of pressing force, and the sealing disc portion 116 can be broken.

Figure 17A:
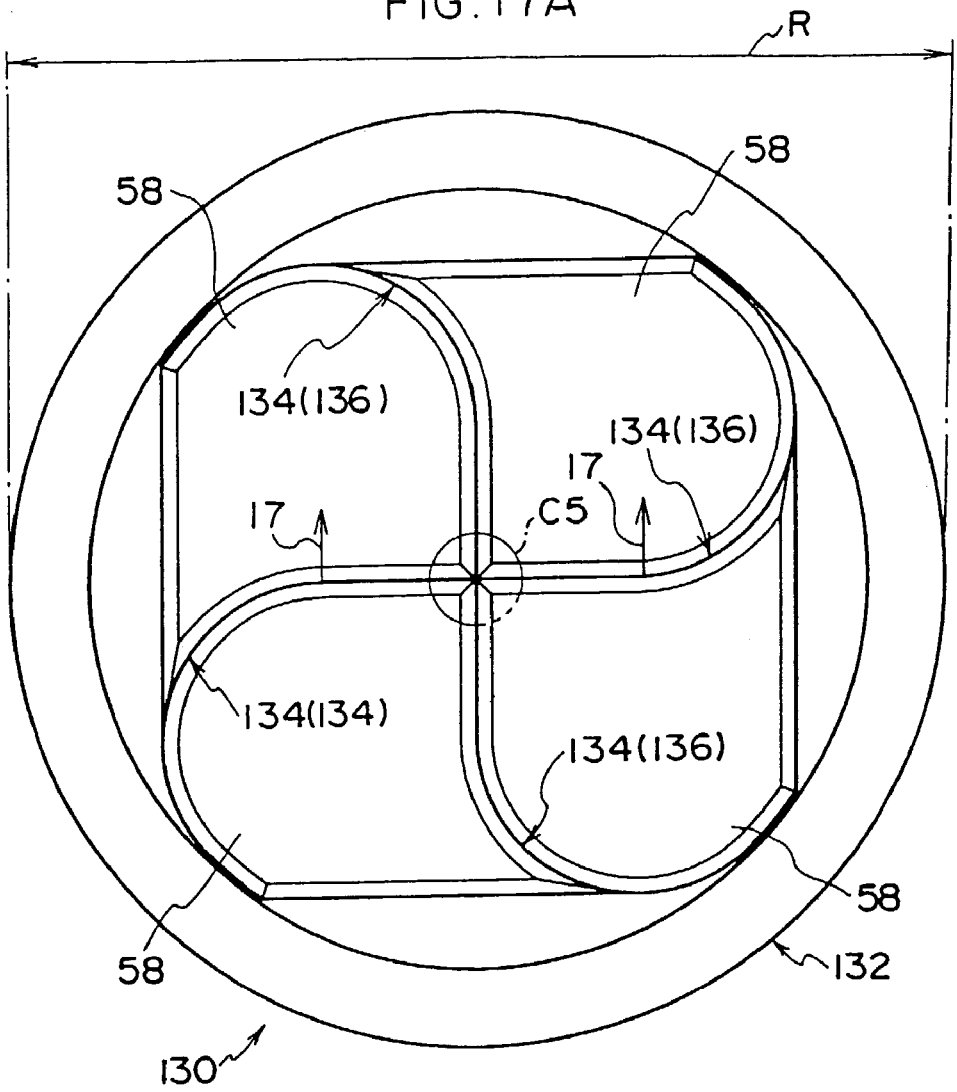
FIG. 17A is a plan view illustrating yet another packing according to the present invention.
Figure 17B:
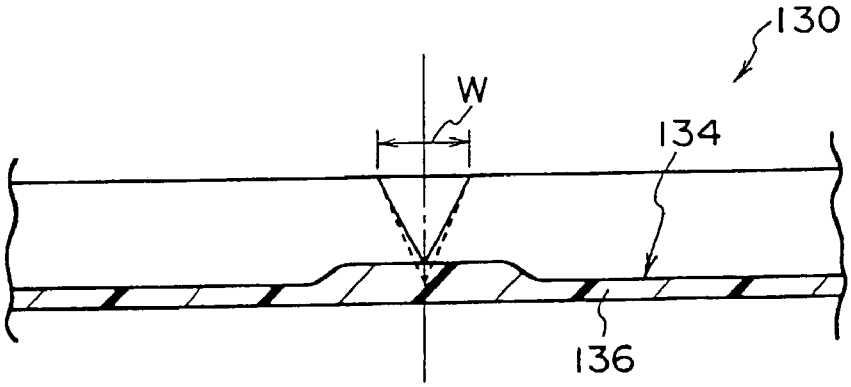
FIG. 17B is a cross sectional view taken along the line XVII—XVII in FIG. 17A and illustrates yet another packing according to the present invention.

A packing 130 as an another example is shown in FIGS. 17A and 17B. In this packing 130, within a predetermined range from the center of a sealing disc portion 132 (within the range indicated by the double-dashed line C5), the thickness of each of thin portions 136 which are formed by grooves 134 is made larger in portions by increasing the angle θ which is formed by the sloping surfaces -60 (see FIGS. 7A and 7B), and the strength thereof thereby increases. For this reason, as compared, for example, to the packing 10 according to the first embodiment of the present invention, at the initial stage of perforating the sealing disc portion 132, it is necessary to press the sealing disc portion 132 with a larger amount of pressing force. However, once splits are formed at each of the thin portions 136, and the tip ends of the splits extend to the range of the sealing disc portion 132 outside the range indicated by the double-dashed line C5, the splits extend to the outside of the sealing disc portion 132 in the radial direction thereof with an extremely small amount of pressing force, and the sealing disc portion 132 can be opened.

Figure 18A:
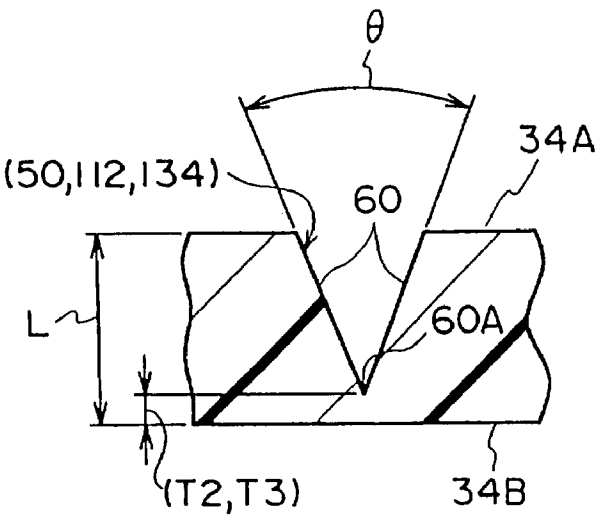
FIG. 18A is an enlarged cross sectional view illustrating grooves of the packing according to the present invention.
Figure 18B:
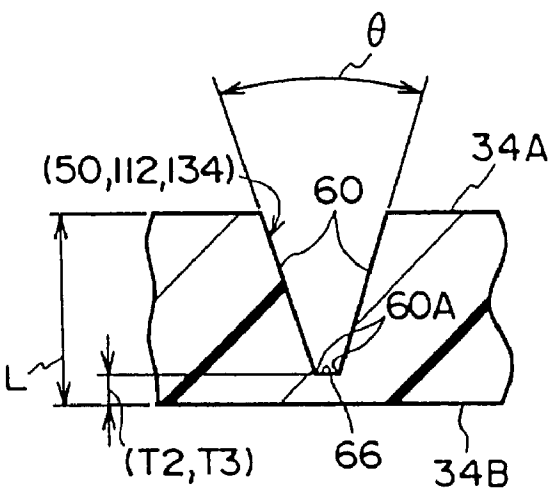
FIG. 18B is an enlarged cross sectional view illustrating grooves which are different from those shown in FIG. 18A.
Figure 18C:
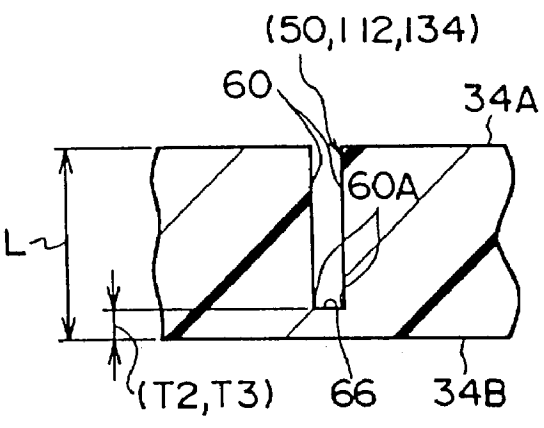
FIG. 18C is an enlarged cross sectional view illustrating grooves which are different from those shown in FIGS. 18A and 18B.
Figure 19:
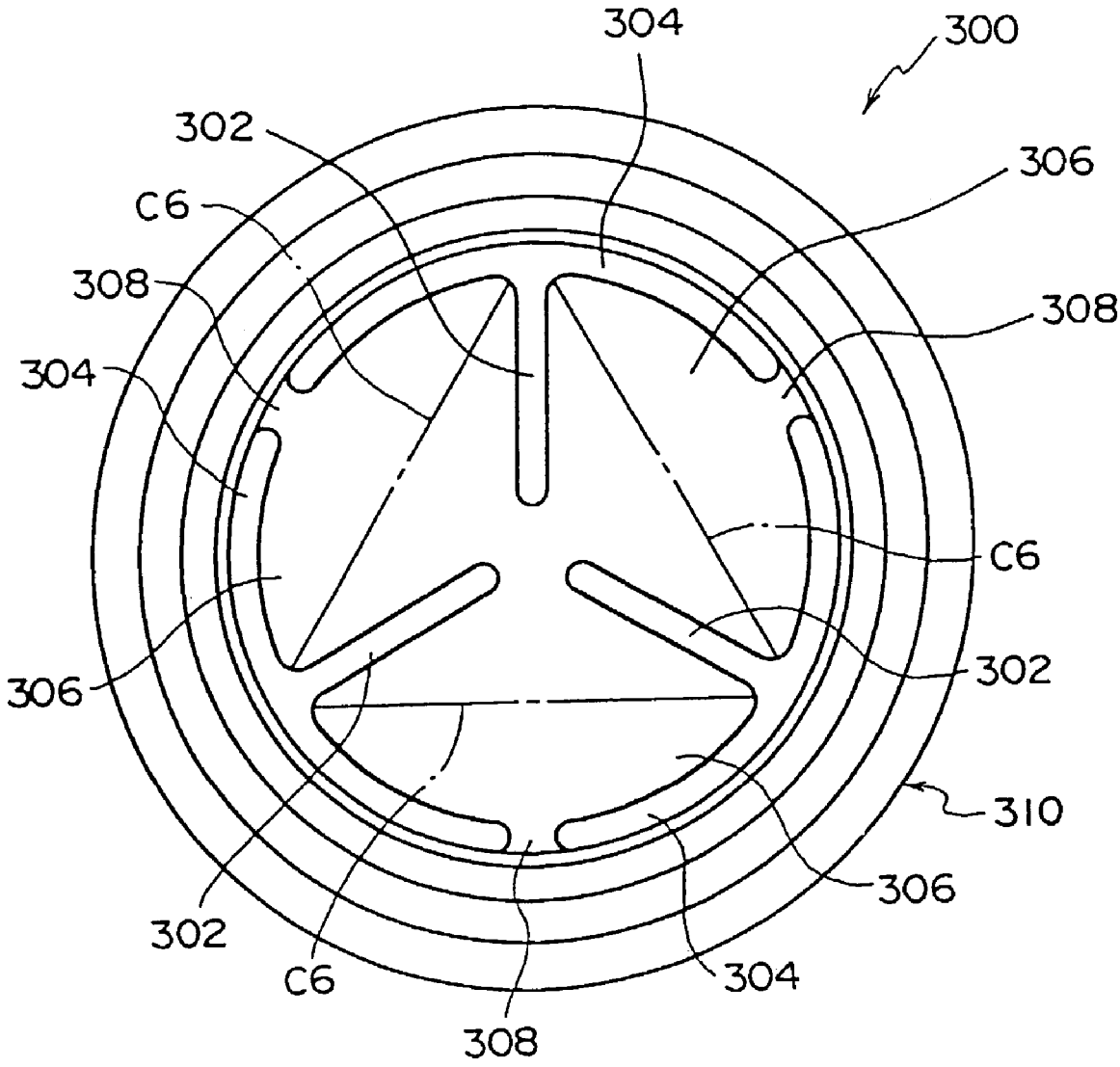
FIG. 19 is a plan view illustrating a conventional plugging sheet.

In the above description, as is also shown in FIG. 18A, an example in which the sloping surfaces 60 which form the grooves 50, 112, and 134 contact with each other at their bottom ends, and the cross sectional view of each of the grooves 50, 112, and 134 is formed in a substantially V-shape has been described. However, the configurations of the grooves 50, 112, and 134 are not limited to this. For example, as shown in FIG. 18B, they can be formed in a substantially trapezoidal configuration in which the bottom ends 60A of the sloping-surfaces 60 do not contact with each other and are separated from each other. A flat portion 66 which is parallel with the rear surface 34B of the sealing disc portion 34 is formed between the bottom ends 60A of the sloping surfaces 60. Further, a curved portion may be formed which is curved so as to form a concave shape protruding towards the rear surface 34B, between the bottom ends 60A of the sloping surfaces 60. Moreover, as shown in FIG. 18C, the sloping surfaces 60 may be formed perpendicular to the top surface 34A and the rear surface 34B, of the sealing disc portion 34 (therefore, in actual fact, the sloping surfaces 60 do not slope) in a rectangular shape having a flat portion 66 between the bottom ends of the sloping surfaces 60.

As to the structure in which the thin portions 62, 114, and 136 have low strength or high strength partially or locally, an example of the structure in which the thicknesses of the thin portions 62, 114, and 136 are increased or decreased by changing the angle θ which is formed by the sloping surfaces 60 has been explained. However, the structure in which each of the thin portions 62, 114, and 136 has low strength or high strength partially or locally is not limited to this. For example, as described above, in the case where the bottom ends 60A of the sloping surfaces 60 are separated from each other by a predetermined distance and each of the thin portions 62, 114 and 136 has the flat portion 66 having a predetermined width, it is possible for each of the thin portions 62, 114 and 136 to have low strength or high strength partially or locally by also changing the width of the flat portion 66. Namely, if the width of the flat portion 66 of each of the thin portions 62, 114 and 136 is made narrower (including the sloping surfaces 60 without a flat portion 66 therebetween, as is shown in FIG. 18A), the tensional force is concentrated within this narrow range. Accordingly, the elongation of the thin portions 62 as a whole in the tensional direction decreases, and the thin portions 62 split easily. However, if the width of the flat portion 66 is made wider, since the tensional force is dispersed within this wider range, the elongation of the thin portions 62 as a whole in the tensional direction increases, and the thin portions 62 do not split easily.

The thin portions 62, 114, and 136 do not necessarily have low strength or high strength partially or locally and instead may have constant strength (thickness T2 or T4) from the center of the sealing disc portion 34 to the outer circumference thereof. Namely, even in this case, provided that the curved grooves 54 which continue in a smooth without deviation from the extending ends 52A of the radial grooves 52 are formed and, provided that the circumferential grooves 56 which continue in a smooth arcuate shape without deviation from the curved grooves 54 along the outer circumference of the sealing disc portion 34 are formed, the sealing disc portion 34 can be opened wide with a small amount of pressing force.

The thin portions 62, 114 and 136 may have a constant strength (constant thickness T4). Namely, even in this case, in the same manner that the ratio (L/T2) of the thickness L of the sealing disc portion 34 to the thickness T2 of the low strength portion 64 is set to be equal to or more than 2, (L/T4) is set to be equal to or more than 2, and the sealing disc portion 34 can thereby be opened wide with a small amount of pressing force.

The number of each of the grooves 50, 112 and 134 is not limited to the above-described number of four. However, even if the pressing force is weak, in order to open the sealing disc portion 34, 116 and 132 widely, the number of grooves is preferably three to five, and more preferably four. Conversely, if the number of the grooves 50, 112, and 134 is six or more, after the opening, the fan portions 58 (see FIG. 4A) of each of the sealing disc portions 34, 116 and 132 contact closely with the pressing means (the perforating pipe 76), and a clearance which is formed between each of the fan portions 58 and the pressing means decreases. On the other hand, if the number of the grooves 50, 112, and 134 is two or less, it becomes difficult to substantially open the sealing disc portions 34, 116, and 132. However, even if the number of grooves is two or less, the grooves can be structured as if the number of the grooves 50, 112 and 134, respectively, were three to five, by curving the grooves so as to be formed in a suitable configuration. If three to five grooves are formed, they don't need to be formed radiating from the center of each of the sealing disc portions 34, 116, and 132 at a fixed central angle.

The grooves 50, 112, and 134 do not need to be formed in a continuous linear shape and, for example, may be formed intermittently at predetermined distances in the longitudinal direction thereof so as to form, as a whole, a series of perforations.

The low strength portions according to the present invention are not limited to the grooves 50, 112, and 134 or grooves which are formed in a perforated shape. For example, a portion, which may be split by the pressing force of the pressing means, can be formed by changing the physical properties of the sealing portions 34, 116, and 132. An example of this is the weld line. A weld line is formed during injection molding of a resin molded product when resin which has flowed out of the gate and diffused around the gate rebonds inside the die. Namely, at portions where a weld line is formed, in many cases, the strength of the resin is deteriorated. Accordingly, molding conditions, the position of the gate, or the like should be set appropriately so that weld lines are formed in the same shape as the thin portions when seen in a plan view.

As described above, the sealing disc portion can be broken along a weld line simply by forming the weld line, however, by further forming the grooves 50, 112, and 134 at the portions where weld lines are formed, it is possible to form a packing which can open with a smaller amount of pressing force.

In the above description, an example in which each of the packings 10, 110, and 130 is formed separately from the cap 12 has been explained. However, the respective packings 10, 110, and 130 may be integrated with and the cap 12. In this way, when each of the packings 10, 110, and 130 are integrated with the cap 12 and, each of the packings 10, 110, and 130 does not fall from the cap 12.

In the above description, an example of the photographic processing chemicals container 14 in which the photographic chemicals are contained has been explained. However, the present invention is not limited to this and instead, any type of container can be used.

As photographic processing chemicals contained in the photographic processing chemicals container 14, for example, a color developing solution, a black & white developing solution, a bleaching solution, a fixing solution, or the like can be listed. These photographic processing chemicals are used to treat a halogen silver photosensitive material, are commercially available, and are known.

In the above description, as a material which forms the packings 10, 110, and 130, unfoamed resin which contains 50% or more of low density polyethylene (LDPE) or 50% or more of high density polyethylene (HDPE) has been listed. However, of course, the present invention is not limited to this and instead, materials are appropriately determined by taking chemical resistance, physical strength, or the like of the materials to be contained in the container into consideration. As described above, when the photographic processing chemicals container 14 in which the photographic processing chemicals are contained is used, from a standpoint of chemical resistance or physical strength, polyethylene is listed as one of the preferable materials.

Especially, in the case in which the packing is formed from a resin material which contains a large amount of low density polyethylene (LDPE), as compared to when the packing is formed from a resin material which contains high density polyethylene (HDPE), because the resin itself is soft, the packing is apt to elongate. Accordingly, the central portion of each of the sealing disc portions 34, 116, and 132 can be broken with a low pressing force. Further, due to the softness of the resin itself, when the distance moved by the perforating pipe 76 is short, it is possible that the central portions of the sealing disc portions 34, 116, and 132 are in an elongated state but are not broken. Even in this case, by providing a sufficient moving distance for the perforating pipe 76, splits which have been formed on the sealing disc portions 34, 116, and 132 are extended to the outside of each of the sealing disc portions 34, 116, and 132 in the radial direction thereof and the sealing disc portions 34, 116, and 132 can be opened wide. Moreover, due to the softness of resin itself, because the sealing disc portions 34, 116, and 132 are apt to elongate, for example, if the photographic processing chemicals container 14 is dropped, even if the internal pressure of the container 14 changes, this change of the internal pressure can be absorbed by the sealing disc portions 34, 116, and 132 being elongated, and packings 10, 110, and 130 which are not broken unexpectedly can be formed.

On the other hand, if the packings 10, 110, and 130 are formed from a resin material which contains a large amount of high density polyethylene (HDPE), as compared to when the packings 10, 110, and 130 are formed from a resin material which contains a large amount of low density polyethylene (LDPE), the resin itself is hard. Accordingly, at the initial stage of breaking the sealing disc portions 34, 116, and 132, a larger amount of pressing force is needed. However, once splits are formed on the sealing disc portions 34, 116, and 132 (the sealing disc portions 34, 116, and 132 are broken), the entire body of each of the sealing disc portions 34, 116, and 132 deforms, and perforating force (tensional force) acts upon the thin portions 62 which are structured by the grooves 50. Accordingly, even if the distance moved by the perforating pipe 76 is small, it is possible to open the sealing disc portions 34, 116, and 132 wide. Further, because the resiliency of the resin material itself is lower than a resin material which contains a large amount of low density polyethylene (LDPE), when each of the sealing disc portions 34, 116, and 132 are opened, due to the resiliency, it becomes difficult for the fan portions 58 to return to the original position they were in before the sealing disc portions were opened so that each of the sealing disc portions 34, 116, and 132 is held in an open shape. For this reason, a clearance which is formed between the fan portions 58 and the perforating pipe 76 due to liquid pressure or the like, when the material contained in the container (photographic processing chemicals or the like) is drained does not decrease, and the draining of the contents can be ensured.

The above-described conditions may be realized by using a resin which contains a large amount of middle density polyethylene (MDPE) having a density range of between 0.930 and 0.941 (g/cm$^3$) in JIS K 6748-1982.

As described above, a method of opening the packing 10, 110, and 130 is not limited to the case in which the photographic processing chemicals container 14 is set in the photographic processing chemicals supplying device 70 (see FIG. 8) in an automatic developer, and the packing 10 is pressed by the perforating pipe 76. For example, the packings 10, 110, and 130 can be pressed by a bar or the like and thereby opened.

What is claimed is:

1. A plug for a drain port in a container for holding a material, the plug comprising:

a substantially flat plug plate body, of one chemical composition, adapted for mounting in said drain port and plugging said drain port when mounted therein, said plug plate body including opposite surfaces having a thickness L defined between the opposite surfaces from one of said opposite surfaces to the other of said opposite surfaces, and at least one groove having one of a rectangular shape, a substantially trapezoidal shape and a substantially V-shape and formed transversely in one of said opposite surfaces, the at least one groove having at least two different depths therein, one depth being a low strength portion where strength is decreased relative to the other depth of the groove by changing a groove thickness, which is defined from a groove bottom to the other of said opposite surfaces, the low strength portion being formed within a predetermined range from a center of said plug plate body, the groove having opposing walls extending from the groove bottom to a top of the groove at said one of said opposite surfaces in which the groove is formed, the groove having a width measured from one of said opposing walls to the other of said opposing walls in a direction parallel to one of said opposite surfaces, the width at the groove top being no less than the width at the groove bottom;

wherein a thickness T2, defining a thinnest one of the groove thicknesses from the bottom of the groove to the other of said opposite surfaces in which the groove is formed, ranges from 0.05 mm to 0.7 mm, wherein the groove walls are disposed relative to one another at an angle θ measured from one opposing wall to the other of said opposing walls, the angle θ ranging from 0° to no more than 120°, and wherein a ratio (L/T2) of the thickness L of said plug plate body to said thickness T2 is equal to or more than 2.

2. A plug according to claim 1, wherein a low strength portion is formed by decreasing the strength of said plug plate body within a predetermined range extending from a center of said plug plate body.

3. A plug according to claim 1 wherein said at least one groove comprises three or more grooves each having at least one low strength portion, the low strength portions defined by thin portions which are formed by decreasing a thickness of said plug plate body, and a portion of said thin portions are low strength portions whose strength is made lower than the other portions of said thin portions.

4. A plug according to claim 1, wherein said plug plate body is formed in a disc plate shape whose outer diameter R is not less than 0.5 cm and not more than 5 cm.

5. A plug according to claim 2, wherein said plug plate body is formed in a disc plate shape whose outer diameter R is not less than 0.5 cm and not more than 5 cm.

6. A plug according to claim 3, wherein a high strength portion is formed at said thin portions by increasing the strength of the thin portions outside of a predetermined range from the center of said plug plate body.

7. A plug according to claim 3, wherein said plug plate body is formed in a disc plate shape whose outer diameter R is not less than 0.5 cm and not more than 5 cm.

8. A plug according to claim 6, wherein said plug plate body is formed in a disc plate shape whose outer diameter R is not less than 0.5 cm and not more than 5 cm.

9. A plug for a drain port in a container, the drain port having an opening with an edge, the plug comprising:

a substantially flat plug plate body adapted for mounting in the opening of the drain port and plugging the drain port when mounted therein, the plug plate body having a central portion and an external edge, and a low strength portion where strength is decreased by a plurality of radial portions formed radiating out from substantially the central portion of said plug plate body toward the external edge thereof, and a plurality of curved portions, wherein the radial portions each include an end tip, and each of said plurality of curved portions extends in an arcuate shape continuing from the end tip of each of said radial portions, respectively, each of said plurality of curved portions including an end tip, and the low strength portion including a circumferential portion extending from the end tip of each of said plurality of curved portions, respectively, in a direction along the edge of the opening of said drain port and wherein each radial portion has a length L1 in the range $$0 \leqq L1 \leqq (4/5) \times R1$$

where R1 is an inner radius of a sealing disc portion.

10. A plug according to claim 9, wherein said low strength portion is a groove which is formed by decreasing a thickness of said plug plate body in portions.

11. A container for holding a material, the container comprising:

(a) a drain port; and (b) a plug of one chemical composition disposed in the drain port, the plug having a substantially flat frangible body plugging said drain port, the frangible body having opposite surfaces and a thickness L measured between the opposite surfaces from one said opposite surface to the other of said opposite surfaces, and a groove having one of a rectangular shape, a substantially trapezoidal shape and a substantially V-shape and formed transversely in one of said opposite surfaces, the groove having at least two different depths therein, one depth being a low strength portion wherein strength is decreased relative to the other depth of the groove by changing a thickness of the groove, the groove thickness being defined from a groove bottom to the other of said opposite surfaces in which the groove is formed, low strength portion being formed within a predetermined range from a center of said body, the groove having opposing walls extending from the groove bottom to a top of the groove at said one of said opposite surfaces in which is the groove is defined, the groove having a width measured from one of said opposing walls to the other of said opposing walls in a direction parallel to one of the opposite surfaces, the width at the top of the groove being no less than at the bottom of the groove;

wherein a thickness T2, defining a thinnest one of the groove thicknesses from the bottom of the groove to the other of said opposite surfaces in which the groove is formed, ranges from 0.05 mm to 0.7 mm;

the opposing groove walls being disposed relative to one another at an angle θ measured from one of said opposing walls to the other of said opposing walls, the angle θ ranging from 0° to no more than 120°; and wherein a ratio (L/T2) of the thickness L of said frangible body to said thickness T2 is equal to or more than 2.

12. A container according to claim 11, wherein said frangible body breaks along the groove when an area of concentrated pressure is applied inwardly to said frangible body when the container is inverted downwardly for permitting material in the container to flow out.

13. A container according to claim 11, wherein the material is a photographic processing chemical.

14. A container for holding a material, the container comprising:

(a) a drain port; and (b) a substantially flat plug removably disposed in the drain port, the plug comprising a plug plate body adapted for mounting in the opening of the drain port and plugging the drain port when mounted therein, the plug plate body having a central portion and an external edge, and a low strength portion where strength is decreased by a plurality of radial portions formed radiating out from substantially the central portion of said plug plate body toward the external edge thereof, and a plurality of curved portions, wherein the radial portions each include an end tip, and each of said plurality of curved portions extends in an arcuate shape continuing from the end tip of each of said radial portions, respectively, each of said plurality of curved portions including an end tip, and the low strength portion including a circumferential portion extending from the end tip of each of said plurality of curved portions, respectively, in a direction along the edge of the opening of said drain port and wherein each radial portion has a length L1 in the range $$0 \leqq L1 \leqq (4/5) \times R1$$

where R1 is an inner radius of a sealing disc portion.

15. A container according to claim 14, wherein said plug plate body breaks along the low strength portion when an area of concentrated pressure is applied inwardly to said plug plate body when the container is inverted downwardly for permitting material in the container to flow out.

16. A container according to claim 14, wherein the material is a photographic processing chemical.

17. A plug according to claim 1, wherein the at least one groove is substantially V-shaped.

18. A container according to claim 11, wherein the groove is substantially V-shaped.

19. A plug according to claim 9, wherein the circumferential portion of the low strength portion forms a circular arc shape.

20. A container according to claim 14, wherein the circumferential portion of the low strength portion forms a circular arc shape.

21. A plug according to claim 2, wherein the strength of said low strength portion is decreased by an increasing depth of the at least one groove.

22. A plug according to claim 3, wherein the strength of the thin portions is decreased by an increasing depth of the at least one groove.

23. A plug according to claim 10, wherein the strength of said low strength portion is decreased by an increasing depth of the groove.

24. A container according to claim 11, wherein the strength of the at least one low strength portion is decreased by an increasing depth of the groove.

25. A container according to claim 14, wherein said low strength portion is a groove which is formed by decreasing a thickness of said plug plate body in portions, the strength of said low strength portion is decreased by an increasing depth of the groove.

26. A plug according to claim 9, wherein a cross-sectional shape of the circumferential portion is different from a cross-sectional shape of the radial portions and the curved portions.

27. A container according to claim 14, wherein a cross-sectional shape of the circumferential portion is different from a cross-sectional shape of the radial portions and the curved portions.

28. A plug for a container containing a photographic processing chemical, wherein the plug is for a drain port of the container, said plug comprising:

a substantially flat plug plate body, having each portion thereof being formed of a same chemical composition, adapted for mounting in said drain port and plugging said drain port when mounted therein, said plug plate body including opposite surfaces having a thickness L defined between the opposite surfaces from one of said opposite surfaces to the other of said opposite surfaces, and at least one groove having one of a substantially rectangular shape, a substantially trapezoidal shape and a substantially V-shape and formed transversely in one of said opposite surfaces, the at least one groove having at least two different depths therein, one depth being a low strength portion where strength is decreased relative to the other depth of the groove by changing a groove thickness, which is defined from a groove bottom to the other of said opposite surfaces, the low strength portion being formed within a predetermined range from a center of said plug plate body, the groove having opposing walls extending from the groove bottom to a top of the groove at said one of said opposite surfaces in which the groove is formed, the groove having a width measured from one of said opposing walls to the other of said opposing walls in a direction parallel to one of said opposite surfaces, the width at the groove top being no less than the width at the groove bottom;

wherein a thickness T2, defining a thinnest one of the groove thicknesses from the groove bottom to the other of said opposite surfaces in which the groove is formed, ranges from 0.05 mm to 0.7 mm, wherein groove walls are disposed relative to one another at an angle θ measured from one of said opposing walls to the other of said opposing walls, the angle θ ranging from 0° to no more than 120°, and wherein a ratio (L/T2) of the thickness L of said plug plate body to said thickness T2 is equal to or greater than 2.

29. A plug for a container containing a photographic processing chemical, wherein the plug is for a drain port of the container, said plug comprising:

a plug plate body adapted for mounting in an opening of the drain port and plugging the drain port when mounted therein, the plug plate body having a central portion and an external edge, and a low strength portion where strength is decreased by a plurality of radial portions formed radiating out from substantially the central portion of said plug plate body toward the external edge thereof, and a plurality of curved portions, wherein the radial portions each include an end tip, and each of said plurality of curved portions extends in an arcuate shape continuing from the end tip of each of said radial portions, respectively, each of said plurality of curved portions including an end tip, and the low strength portion including a circumferential portion extending from the end tip of each of said plurality of curved portions, respectively, in a direction along an edge of the opening of said drain port to form a circular arc shape and wherein each radial portion has a length L1 in the range $$0 \leqq L1 \leqq (4/5) \times R1$$

wherein groove walls are disposed relative to one another at an angle θ measured from one of said opposing walls to the other of said opposing walls, the angle θ ranging from 0° to no more than 120°, and wherein a ratio (L/T2) of the thickness L of said plug plate body to said thickness T2 is equal to or greater than 2.

30. A plug for a drain port in a container for holding a material, the plug comprising:

a substantially flat plug plate body, having each portion thereof being formed of a same chemical composition, adapted for mounting in said drain port and plugging said drain port when mounted therein, said plug plate body including opposite surfaces having a thickness L defined between the opposite surfaces from one of said opposite surfaces to the other of said opposite surfaces, and at least one groove having one of a substantially rectangular shape, a substantially trapezoidal shape and a substantially V-shape and formed transversely in one of said opposite surfaces, the at least one groove having at least two different depths therein, one depth being a low strength portion where strength is decreased relative to the other depth of the groove by changing a groove thickness, which is defined from a groove bottom to the other of said opposite surfaces, the low strength portion being formed within a predetermined range from a center of said plug plate body, the groove having opposing walls extending from the groove bottom to a top of the groove at said one of said opposite surfaces in which the groove is formed, the groove having a width measured from one of said opposing walls to the other of said opposing walls in a direction parallel to one of said opposite surfaces, the width at the top of the groove being no less than the width at the groove bottom;

wherein a thickness T2, defining a thinnest one of the groove thicknesses from the groove bottom to the other of said opposite surfaces in which the groove is formed, ranges from 0.05 mm to 0.7 mm, groove is formed, ranges from 0.05 mm to 0.7 mm, and a ratio (L/T2) of the thickness L of said plug plate body to said thickness T2 is equal to or greater than 2.

31. A container for holding a material, the container comprising:

(a) a drain port; and (b) a plug having each portion thereof being formed of a same chemical composition, disposed in the drain port, the plug having a substantially flat frangible body plugging said drain port, the frangible body having opposite surfaces and a thickness L measured between the opposite surfaces from one of said opposite surfaces to the other of said opposite surfaces, and including at least two grooves having different groove thicknesses, each thickness is defined from a bottom of the groove to one of said opposite surfaces which does not include the groove, at least one of said grooves having one of a substantially rectangular shape, a substantially trapezoidal shape and a substantially V-shape and formed transversely in one of said opposite surfaces, the at least one groove having opposing walls extending from the bottom of the groove to a top of the groove at said one of said opposite surfaces in which the groove is formed, the at least one groove having a width measured from one of said opposing wall to the other of said opposing walls in a direction parallel to one of the opposite surfaces, the width at the top of the groove being no less than at the bottom of the groove;

wherein a thickness T2, defining a thinnest one among all of the groove thicknesses from the bottom of the groove to the other of said opposite surfaces in which the groove is formed, ranges from 0.05 mm to 0.7 mm;

at least one set of opposing groove walls being disposed relative to one another at an angle θ measured from one of said opposing walls to the other of said opposing walls, the angle θ ranging from 0° to no more than 120°, and wherein a ratio (L/T2) of the thickness L of said frangible body to said thickness T2 is equal to or greater than 2.

32. A plug for a container containing a photographic processing chemical, wherein the plug is for a drain port of the container, said plug comprising:

a substantially fiat plug plate body, having each portion thereof being formed of a same chemical composition, adapted for mounting in said drain port and plugging said drain port when mounted therein, said plug plate body including opposite surfaces having a thickness, L defined between the opposite surfaces from one of said opposite surfaces to the other of said opposite surfaces, and including at least two grooves having different groove thicknesses, each thickness is defined from a bottom of the groove to one of said opposite surfaces which does not include the groove, at least one of the grooves having one of a substantially rectangular shape, a substantially trapezoidal shape and a substantially V-shape and formed transversely in one of said opposite surfaces, the at least one groove having opposing walls extending from the bottom of the groove to a top of the groove at said one of said opposite surfaces in which the groove is formed, the at least one groove having a width measured from one of said opposing walls to the other of said opposing walls in a direction parallel to one of said opposite surfaces, the width at the top of the groove being no less than the width at the bottom of the groove;

wherein a thickness T2, defining a thinnest one of the groove thicknesses from the bottom of the groove to the other of said opposite surfaces in which the groove is formed, ranges from 0.05 mm to 0.7 mm, at least one set of opposing groove walls are disposed relative to one another at an angle e measured from one of said opposing walls to the other of said opposing walls, the angle θ ranging from 0° to no more than 120°, and wherein a ratio (L/T2) of the thickness L of said plug plate body to said thickness T2 is equal to or greater than 2.

33. A plug for a drain port in a container for holding a material, the plug comprising:

a substantially flat plug plate body, having each portion thereof being formed of a same chemical composition, adapted for mounting in said drain port and plugging said drain port when mounted therein, said plug plate body including opposite surfaces having a thickness L defined between the opposite surfaces from one of said opposite surfaces to the other of said opposite surfaces, and at least two grooves having a difference in one of a) shape of cross-section and b) size of the shape of the cross-section;

wherein a thickness T2, defining a thinnest one among all groove thicknesses from a bottom of the groove to the other of said opposite surfaces in which the where R1 is an inner radius of a sealing disc portion.

34. A container for holding a material, the container comprising:

(a) a drain port; and (b) a plug having each portion thereof being formed of a same chemical composition, disposed in the drain port, the plug having a substantially flat frangible body plugging said drain port, the frangible body having opposite surfaces and a thickness L measured between the opposite surfaces from one of said opposite surfaces to the other of said opposite surfaces, and at least two grooves having a difference in one of a) shape of cross-section and b) size of the shape of the cross-section;

wherein a thickness T2, defining a thinnest one among all groove thicknesses from a bottom of the groove to the other of said opposite surfaces in which the groove is formed, ranges from 0.05 mm to 0.7 mm, and a ratio (L/T2) of the thickness L of said frangible body to said thickness T2 is equal to or greater than 2.

35. A plug for a container containing a photographic processing chemical, wherein the plug is for a drain port of the container, said plug comprising:

a substantially flat plug plate body, having each portion thereof being formed of a same chemical composition, adapted for mounting in said drain port and plugging said drain port when mounted therein, said plug plate body including opposite surfaces having a thickness L defined between the opposite surfaces from one of said opposite surfaces to the other of said opposite surfaces, and at least two grooves having a difference in one of a) shape of cross-section and b) size of the shape of the cross-section;

wherein a thickness T2, defining a thinnest one among all groove thicknesses from a bottom of the groove to the other of said opposite surfaces in which the groove is formed, ranges from 0.05 mm to 0.7 mm, and a ratio of the thickness L of said plug plate body to said thickness T2 is equal to or greater than 2.

36. A plug according to claim 9, wherein a radius of curvature R2 of the curved portion and an internal circumference R1 of the sealing disc portion satisfies the following relationship:

$$R1/5 \leqq R2.$$

37. A container according to claim 14, wherein a radius of curvature R2 of the curved portion and an internal circumference R1 of the sealing disc portion satisfies the following relationship:

$$R1/5 \leqq R2.$$

38. A plug for a container according to claim 29, wherein a radius of curvature R2 of the curved portion and an internal circumference R1 of the sealing disc portion satisfies the following relationship:

$$R1/5 \leqq R2.$$

39. A plug according to claim 9, further comprising at least one thin portion which is provided along an internal circumference of the sealing disc portion.

40. A container according to claim 14, further comprising at least one thin portion which is provided along an internal circumference of the sealing disc portion.

41. A plug for a container according to claim 29, further comprising at least one thin portion which is provided along an internal circumference of the sealing disc portion.

42. A plug according to claim 39, wherein the at least one thin portion is formed to have a substantially arcuate shape as seen from a plan view.

43. A container according to claim 40, wherein the at least one thin portion is formed to have a substantially arcuate shape as seen from a plan view.

44. A plug for a container according to claim 41, wherein the at least one thin portion is formed to have a substantially arcuate shape as seen from a plan view.

45. A plug according to claim 30, wherein one of the at least one groove(s) is a thin portion formed to have a substantially arcuate shape as seen from a plan view.

46. A container according to claim 31, wherein one of the at least one groove(s) is a thin portion formed to have a substantially arcuate shape as seen from a plan view.

47. A plug for a container according to claim 32, wherein one of the at least one groove is a thin portion formed to have a substantially arcuate shape as seen from a plan view.

48. A plug according to claim 33, wherein one of the at least one groove(s) is a thin portion formed to have a substantially arcuate shape as seen from a plan view.

49. A container according to claim 34, wherein one of the at least one groove(s) is a thin portion formed to have a substantially arcuate shape as seen from a plan view.

50. A plug for a container according to claim 35, wherein one of the at least one groove is a thin portion formed to have a substantially arcuate shape as seen from a plan view.

51. A plug for a drain port in a container for holding a material, the plug comprising:

a substantially flat plug plate body, having each portion thereof being formed of a same chemical composition, adapted for mounting in said drain port and plugging said drain port when mounted therein, said plug plate body including opposite surfaces having a thickness L defined between the opposite surfaces from one of said opposite surfaces to the other of said opposite surfaces, and having thin portions, with reduced strength, at a circumferential portion and at a central portion of a plane of the plug plate body, the thin portions at the circumferential portion and the thin portions at the central portion being different in one of a) thickness, b) shape of cross-section and c) size of the shape of the cross-section;

wherein one of the thin portions at the central portion is formed linearly with a straight line, a curved line or combination of the straight line and the curved line extending toward an external edge from an essential center portion of the plug plate body when seen from a plan view, wherein one of the thin portions at the circumferential portion is formed to have a substantially arcuate shape as seen from a plan view, and wherein a thickness T2, defining a minimum thickness of the thin portions, ranges from 0.05 mm to 0.7 mm, and a ratio (L/T2) of the thickness L of said plug plate body to said thickness T2 is equal to or greater than 2.

52. A container for holding a material, the container comprising:

(a) a drain port; and (b) a plug having each portion thereof being formed of a same chemical composition, disposed in the drain port, the plug having a substantially flat frangible body plugging said drain port, the frangible body having opposite surfaces and a thickness L measured between the opposite surfaces from one of said opposite surfaces to the other of said opposite surfaces, and having thin portions, with reduced strength, at a circumferential portion and at a central portion of a plane of the plug plate body, the thin portions at the circumferential portion and the thin portions at the central portion being different in one of a) thickness, b) shape of cross-section and c) size of the shape of the cross-section;

wherein one of the thin portions at the central portion is formed linearly with a straight line, a curved line or combination of the straight line and the curved line extending toward an external edge from an essential center portion of the plug plate body when seen from a plan view, wherein one of the thin portions at the circumferential portion is formed to have a substantially arcuate shape as seen from a plan view, and wherein a thickness T2, defining a minimum thickness of the thin portions, ranges from 0.05 mm to 0.7 mm, and a ratio (L/T2) of the thickness L of said frangible body to said thickness T2 is equal to or greater than 2.

53. A plug for a container containing a photographic processing chemical, wherein the plug is for a drain port of the container, said plug comprising:

a substantially flat plug plate body, having each portion thereof being formed of a same chemical composition, adapted for mounting in said drain port and plugging said drain port when mounted therein, said plug plate body including opposite surfaces having a thickness L defined between the opposite surfaces from one of said opposite surfaces to the other of said opposite surfaces, and having thin portions, with reduced strength at a circumferential portion and at a central portion of a plane of the plug plate body, the thin portions at the circumferential portion and the thin portions at the central portion being different in one of a) thickness, b) shape of cross-section and c) size of the shape of the cross-section;

wherein one of the thin portions at the central portion is formed linearly with a straight line, a curved line or combination of the straight line and the curved line extending toward an external edge from an essential center portion of the plug plate body when seen from a plan view, wherein one of the thin portions at the circumferential portion is formed to have a substantially arcuate shape as seen from a plan view, and wherein a thickness T2, defining a minimum thickness of the thin portions, ranges from 0.05 mm to 0.7 mm, and a ratio (L/T2) of the thickness L of said plug plate body to said thickness T2 is equal to or greater than 2.

* * * * *